US011255038B2

(12) United States Patent
Tartuferi et al.

(10) Patent No.: US 11,255,038 B2
(45) Date of Patent: Feb. 22, 2022

(54) LAUNDRY WASHING MACHINE EQUIPPED WITH A TREATING AGENTS DISPENSER

(71) Applicant: Electrolux Appliances Aktiebolag, Stockholm (SE)

(72) Inventors: Mariano Tartuferi, Porcia (IT); Mauro Cinello, Porcia (IT); Daniele Da Riol, Porcia (IT); Helena Romito, Porcia (IT); Maurizio Del Pos, Porcia (IT)

(73) Assignee: Electrolux Appliances Aktiebolag

( * ) Notice: Subject to any disclaimer, the term of this patent is extended or adjusted under 35 U.S.C. 154(b) by 31 days.

(21) Appl. No.: 16/329,831

(22) PCT Filed: Aug. 23, 2017

(86) PCT No.: PCT/EP2017/071182
§ 371 (c)(1),
(2) Date: Mar. 1, 2019

(87) PCT Pub. No.: WO2018/041682
PCT Pub. Date: Mar. 8, 2018

(65) Prior Publication Data

US 2019/0226138 A1 Jul. 25, 2019

(30) Foreign Application Priority Data

Sep. 5, 2016 (EP) ..... 16187291

(51) Int. Cl.
*D06F 39/02* (2006.01)
*D06F 21/04* (2006.01)

(52) U.S. Cl.
CPC ..... *D06F 39/02* (2013.01); *D06F 21/04* (2013.01); *D06F 39/028* (2013.01)

(58) Field of Classification Search
CPC ..... D06F 39/028; D06F 39/02; D06F 21/04
See application file for complete search history.

(56) References Cited

U.S. PATENT DOCUMENTS 7,654,119 B2 * 2/2010 Song ..... D06F 39/02 68/17 R
8,348,361 B2 * 1/2013 Joerger ..... D06F 39/02 312/334.18

(Continued)

FOREIGN PATENT DOCUMENTS

CN 2830466 Y 10/2006
CN 1868317 A 11/2006

(Continued)

OTHER PUBLICATIONS

Chinese Office Action for Chinese Application No. 201780052899.3, dated Jul. 17, 2020, with translation, 18 pages.

(Continued)

*Primary Examiner* — Benjamin L Osterhout
(74) *Attorney, Agent, or Firm* — RatnerPrestia

(57) ABSTRACT

A laundry washing machine equipped with a treating agents dispenser comprising a drawer having an upper side comprising one or more open-top compartments for receiving at least one agent for treating laundry and a water distributor arranged above said drawer. A cover element is arranged between the drawer and the water distributor and the cover element comprises at least one aperture positioned above one of said one or more open-top compartments.

25 Claims, 19 Drawing Sheets

(56) References Cited

U.S. PATENT DOCUMENTS

| | | | | |
|---|---|---|---|---|
| 2009/0119849 | A1* | 5/2009 | Hill | D06F 39/02 8/158 |
| 2009/0322195 | A1* | 12/2009 | Joerger | D06F 39/02 312/334.1 |
| 2011/0277515 | A1* | 11/2011 | Doh | D06F 39/02 68/17 R |
| 2012/0060568 | A1* | 3/2012 | Buso | D06F 39/088 68/17 R |
| 2014/0352364 | A1* | 12/2014 | Martinez Villarreal | D06F 39/028 68/17 R |

FOREIGN PATENT DOCUMENTS

| | | | |
|---|---|---|---|
| CN | 101177899 | A | 5/2008 |
| CN | 102666965 | A | 9/2012 |
| CN | 203795188 | U | 8/2014 |
| EP | 1607509 | A1 | 12/2005 |
| EP | 2519676 | B1 | 11/2012 |
| EP | 2703545 | A2 | 3/2014 |
| KR | 20140064420 | A | 5/2014 |
| WO | 2011080088 | A2 | 7/2011 |
| WO | 2015065301 | A1 | 5/2015 |

OTHER PUBLICATIONS

International Search Report and Written Opinion for International Application No. PCT/EP2017/071182, dated Nov. 15, 2017—10 pages.

Opposition Request to Amend Patent No. EP3290568, dated Apr. 2, 2021, 137 pages.

Opposition Opinion for Patent No. EP3290568, dated Nov. 23, 2020, 20 pages.

Opposition Request to Amend for Patent No. EP3290568, dated Jul. 13, 2020, 77 pages.

Opposition Consolidated List of References for Patent No. EP3290568, dated Mar. 2, 2020, 7 pages.

Opposition Letter for Patent No. EP3290568, dated Feb. 21, 2020, 8 pages.

Opposition EPO Opinion for Patent No. EP3290568, dated Jul. 26, 2021, 12 pages.

Opposition Request for Patent No. EP3290568, dated Dec. 20, 2019, 94 pages.

Drawing Figures, 10 pages, admitted to predate Mar. 1, 2019.

* cited by examiner

LAUNDRY WASHING MACHINE EQUIPPED WITH A TREATING AGENTS DISPENSER

This application is a U.S. National Phase application of PCT International Application No. PCT/EP2017/071182, filed Aug. 23, 2017, which claims the benefit of EP 16187291.6, filed Sep. 5, 2016, both of which are incorporated by reference herein.

The present invention concerns the field of laundry washing techniques.

In particular, the present invention refers to a treating agents dispenser in a laundry washing machine.

BACKGROUND ART

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machine and laundry washing-drying machine.

Laundry washing machines generally comprise an external casing, or cabinet, provided with a washing tub which contains a rotatable perforated drum where the laundry is placed. A loading/unloading door ensures access to the drum.

Laundry washing machines typically comprise a treating agents dispenser for the introduction of water and treating agents (i.e. detergent, softener, rinse conditioner, etc.) into the tub.

Known treating agents dispensers comprise a drawer having one or more open topped compartments adapted to be filled with at least one treating agent and one or more respective channels for conveying water to the compartments.

Treating agents dispenser also comprises a housing on which the drawer can slide from a normal closed position to an opening position.

The housing is typically mounted at an opening provided on the upper part of the front side of the cabinet. The opening allows entrance and exit of the drawer so that it can be positioned by the user in said positions.

The housing of the known type preferably has a box-like structure comprising upright side walls which are connected below by a bottom side wall.

The treating agents dispenser then comprises a water distributor which preferably connects above the upright side walls of the housing. The water distributor is advantageously placed above the compartments and opportunely shaped to define said channels which are provided with apertures allowing water coming from an external water source to fall down in the underlying compartments.

The bottom side wall of the housing communicates with a supply pipe connected to the tub for guiding and supplying the water, which passes through the compartments and which mixes with the treating agent, into the tub.

Compartments are opportunely shaped to allow the treating agent and water flowing therethrough to reach the bottom side of the housing and then, from there, to the tub through the supply pipe.

In preferred known embodiments, compartments comprise an outlet aperture through which water and treating agent flow. The mixed liquid then flows towards the bottom side of the housing. In further preferred known embodiments, compartments comprise a siphon. Water coming from the channel flushed into the compartment triggers the siphon and treating agent is drawn through the siphon. Treating agent and water then fall down into the housing.

In further preferred know embodiments, compartments are shaped so that water and treating agent overflow from the compartment and fall down into the housing.

However, the treating agents dispensers belonging to the known art poses some drawbacks.

A first drawback posed by the treating agents dispensers of the known art lies in that the treating agent which is inserted into the respective compartment, in particular when a powder treating agent is used, is not totally flushed by water falling down from the apertures of the water distributor channels and residues of the treating agent are left in the compartment. Residues of treating agent may accumulate and may form a sticky, gelatinous mass, which will ultimately adhere to the side walls of the compartment.

Another drawback posed by the treating agents dispensers of the known art is that the accumulation of treating agent may favour the proliferation of bacteria, which may then worsen the hygienic conditions and may cause bad smells.

Furthermore, accumulation of treating agent causes not all the treating agent inserted in the compartment to be used during the washing cycle and thus a washing efficiency reduction occurs.

Furthermore, washing performance may be different for each washing program depending on the percentage of product left on the compartment. Therefore, the washing performance may vary from time to time and cannot be properly controlled.

The object of the present invention is therefore to overcome the drawbacks posed by the known technique.

It is a first object of the invention to provide a laundry washing machine that makes it possible to reduce or prevent residues of treating agent in the treating agents dispensers.

It is another object of the invention to provide a laundry washing machine that makes it possible to reduce proliferation of bacteria therefore improving hygienic conditions.

It is another object of the invention to provide a laundry washing machine that makes it possible to improve the washing efficiency of the machine itself.

It is a further object of the invention to provide a laundry washing machine that makes it possible to guarantee invariable efficiency during the time.

DISCLOSURE OF INVENTION

The applicant has found that by providing a laundry washing machine having a treating agents dispenser comprising a drawer having one or more open-top compartments for receiving at least one agent for treating laundry wherein a cover element is associated to the upper side of the drawer, preferably movably connected to the upper side of the drawer, it is possible to reduce or prevent residues of treating agent in the treating agents dispensers compared to known techniques.

The present invention relates, therefore, to a laundry washing machine connectable to an external water source comprising a cabinet supporting a washing tub enclosing a rotatable washing drum suited to receive laundry and a treating agents dispenser connectable to said external water source and fluidly connected to said washing tub, said treating agents dispenser comprising:

- a drawer having an upper side comprising one or more open-top compartments for receiving at least one agent for treating laundry;

a supporting structure on which said drawer can slide;

a water distributor arranged above said drawer and comprising at least one channel for conveying water from said external water source to at least one of said one or more compartments of said drawer;

wherein a cover element is arranged between said drawer and said water distributor and wherein said cover element comprises at least one aperture positioned above one of said one or more open-top compartments.

Preferably, the cover element comprises an upper side and an opposite underside, wherein the upper side of the cover element faces the water distributor and the underside side of the cover element faces the upper side of the drawer.

In a preferred embodiment of the invention, a first aperture of said at least one aperture of the cover element is positioned above a first compartment of said one or more open-top compartments and a second aperture of said at least one aperture of the cover element is positioned above a second compartment of said one or more open-top compartments.

In a further preferred embodiment of the invention, two apertures of said at least one aperture of the cover element are positioned above a first compartment of said one or more open-top compartments.

According to a preferred embodiment of the invention, the size of said at least one aperture is smaller than the size of the underlying compartment. Preferably, the boundary line of the at least one aperture is smaller than the boundary line of the underlying compartment.

In a preferred embodiment of the invention, at least a portion of the boundary line of said at least one aperture follows the boundary line of the underlying compartment.

Preferably, said at least one aperture comprises a rim extending downwardly from the boundary line towards the underlying compartment.

According to a preferred embodiment of the invention, at least a portion of the rim is received in a recess of the underlying compartment.

In a preferred embodiment of the invention, the cover element comprises at least one level indicator for said at least one treating agent. Preferably, said rim comprises said level indicator.

Preferably, the drawer comprises a border rim which at least partially externally delimits the compartments and the cover element peripherally borders said border rim of the drawer.

Preferably, the size of said cover element is substantially equal to the size of said drawer or the length of the cover element is substantially equal to the length of the drawer or the width of the cover element is substantially equal to the width of the drawer.

In a preferred embodiment of the invention, the cover element has a length so that it is partially inserted in the supporting structure when the drawer is in its maximum opened position.

According to a preferred embodiment of the invention, the cover element is removably connected to the upper side of the drawer.

In a preferred embodiment of the invention, the treating agents dispenser comprises a release device releasably connecting the cover element to the drawer.

Preferably, the release device releasably connects the cover element to an upper side of the drawer According to a preferred embodiment of the invention, a first one of said at least one aperture is realized in a first surface of an upper side of the cover element and a second one of said at least one aperture is realized in a second surface of the upper side of the cover element, wherein the first surface is at a different level with respect to the second surface.

Preferably, a first one of said at least one aperture is realized in a first surface of the upper side of the cover element and a second one of said at least one aperture is realized in a second surface of the upper side of the cover element, wherein the first surface and the second surface are separated by a protective barrier.

In a preferred embodiment of the invention, at least one of said one or more compartments comprises and outlet apt to fluidly connecting said at least one of said one or more compartments to an underside of the drawer. Preferably, said outlet comprises a siphon.

According to a preferred embodiment of the invention, the underside of said cover element comprises a cap siphon. Preferably, the cap siphon is integrally made with the cover element.

BRIEF DESCRIPTION OF THE DRAWINGS

Further characteristics and advantages of the present invention will be highlighted in greater detail in the following detailed description of preferred embodiments of the invention, provided with reference to the enclosed drawings. In the drawings, corresponding characteristics and/or components are identified by the same reference numbers. In such drawings.

DETAILED DESCRIPTION OF THE INVENTION

Figure 2:
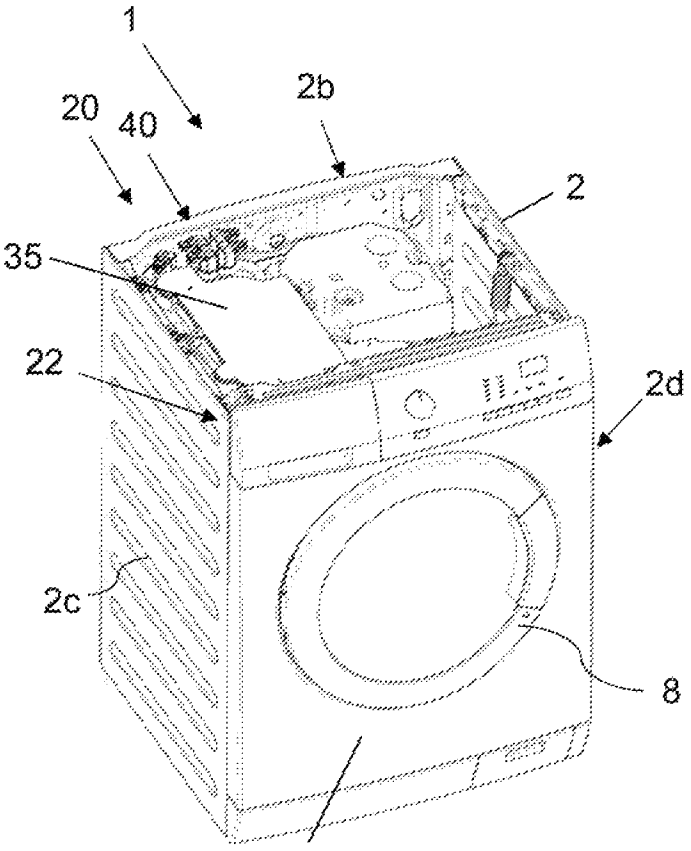
FIG. 2 shows the laundry washing machine of FIG. 1 with the upper side wall removed therefrom.

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

In the present description, therefore, the term "laundry washing machine" will refer to both simple laundry washing machine and laundry washing-drying machine.

A laundry washing machine 1 equipped with a treating agents dispenser 20 according to a preferred embodiment of the invention is described with reference to FIGS. 1 to 16.

The laundry washing machine 1 comprises an external casing or cabinet 2 in which a washing tub, not shown, is provided that contains a perforated washing drum, not shown, where the laundry to be treated can be loaded. The cabinet 2 comprises a vertical front side wall 2*a*, a vertical rear side wall 2*b*, two vertical lateral side walls 2*c*, 2*d* and an upper side wall 2*e*.

The cabinet 2 is provided with a loading/unloading door 8 which allows access to the drum.

The tub is preferably suspended in a floating manner inside the cabinet 2, advantageously by means of a number of coil springs and shock-absorbers.

The drum is advantageously rotated by an electric motor (not shown) which preferably transmits the rotating motion to the shaft of the drum, advantageously by means of a belt/pulley system (not shown). In a different embodiment of the invention, the motor can be directly associated with the shaft of the drum.

The drum is advantageously provided with holes which allow the liquid flowing therethrough. Said holes are typically and preferably homogeneously distributed on the cylindrical side wall of the drum.

Laundry washing machine 1 advantageously comprises a control unit (not shown), connected to the various parts of the laundry washing machine 1 in order to ensure its operation. Laundry washing machine 1 preferably comprises an interface unit 16, connected to the control unit, accessible to the user and by means, of which the user may select and set the washing parameters, like for example a desired washing program. Usually, other parameters can optionally be inserted by the user, for example the washing temperature, the spinning speed, etc. The interface unit 16 preferably comprises a display 16*a* which displays machine working conditions.

The unit interface 16 then preferably comprises one or more selector devices which allow to select the appropriate washing program and/or to set other parameters.

For example, the selector device may comprise a rotary knob 16*b* which advantageously allows to select the appropriate washing program. The selector devices may then preferably comprise push buttons.

The laundry washing machine 1 advantageously comprises said treating agents dispenser 20 to supply treating agents into the tub during a washing cycle. Treating agents may comprise, for example, detergents, rinse additives, fabric softeners or fabric conditioners, waterproofing agents, fabric enhancers, rinse sanitization additives, chlorine-based additives, etc.

Advantageously, the treating agents dispenser 20 comprises a supporting structure 21, connected to the cabinet 2, internally to the latter, preferably by suitable fixing means, comprising, for example, screws or rivets, not illustrated, or also glue, or welding.

Figure 6:
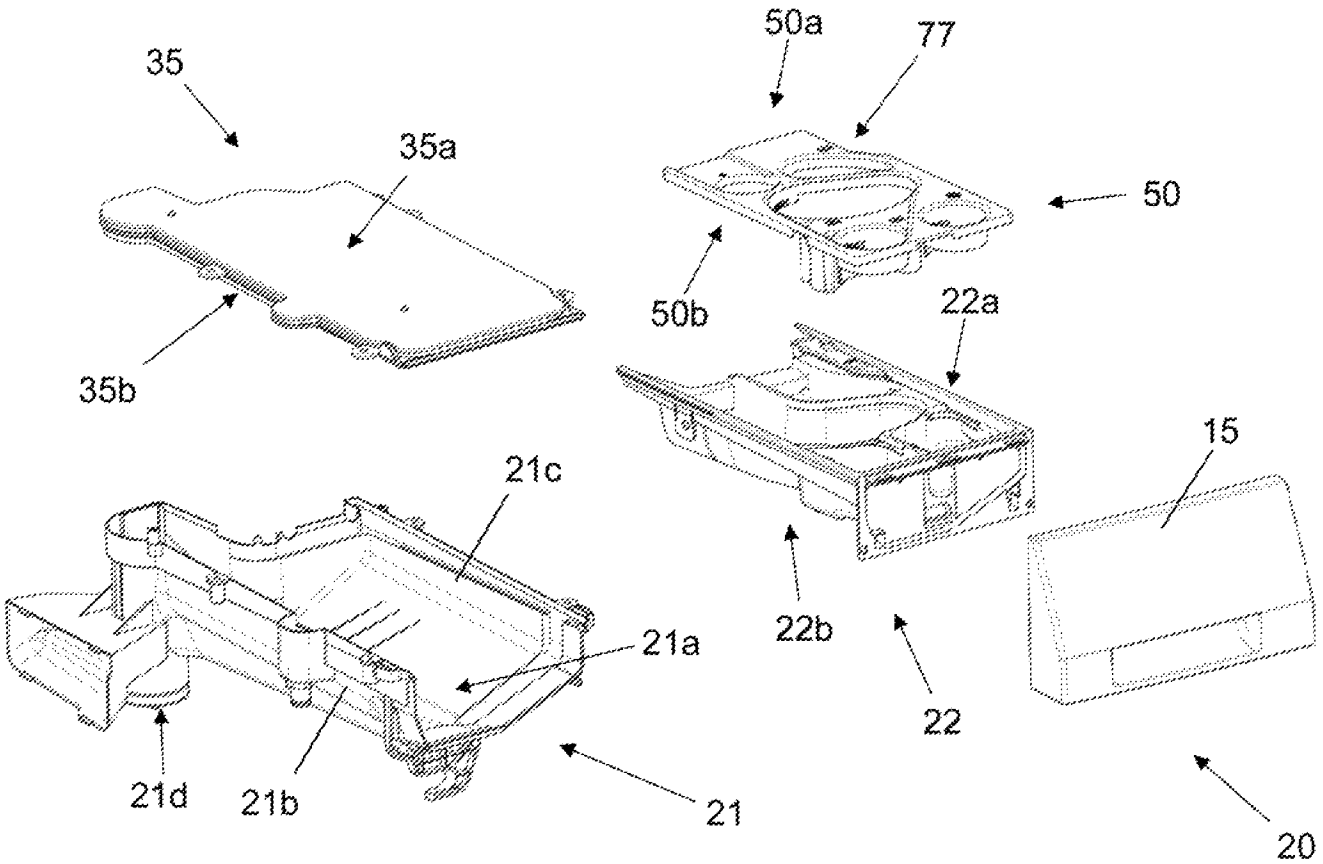
FIG. 6 shows an exploded view of the treating agents dispenser of FIG. 5.

Preferably, the supporting structure 21 comprises a housing, more preferably a box-shaped housing 21, as illustrated in FIG. 6.

In the enclosed Figures, the housing 21 is advantageously substantially parallelepiped and it is connected to the frontal side wall 2*a* of the cabinet 2, opportunely in an upper region of the latter, positioned above the tub.

The housing 21 preferably comprises a bottom side wall 21*a* and lateral vertical side walls 21*b*, 21*c*, as visible in FIG. 6.

An outlet port 21*d* is preferably defined at the rear portion of the bottom side wall 21*a*. The outlet port 21*d* is adapted to allow the flowing of a liquid into a supply pipe (not shown) fluidly connecting the treating agents dispenser 20 to the washing tub.

Figure 1:
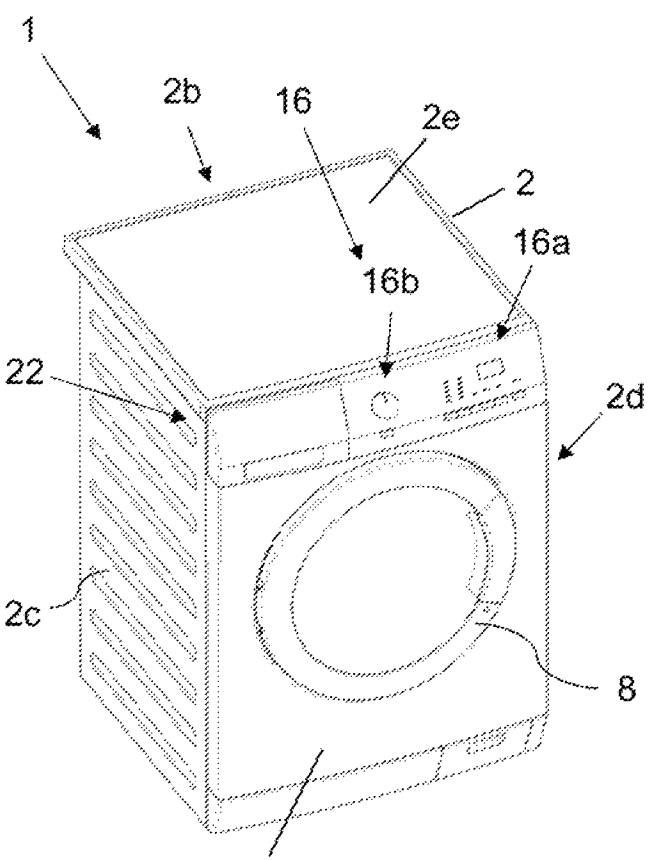
FIG. 1 shows a perspective view of a laundry washing machine equipped with a treating agents dispenser with the drawer in its closed position according to a preferred embodiment of the invention.
Figure 3:
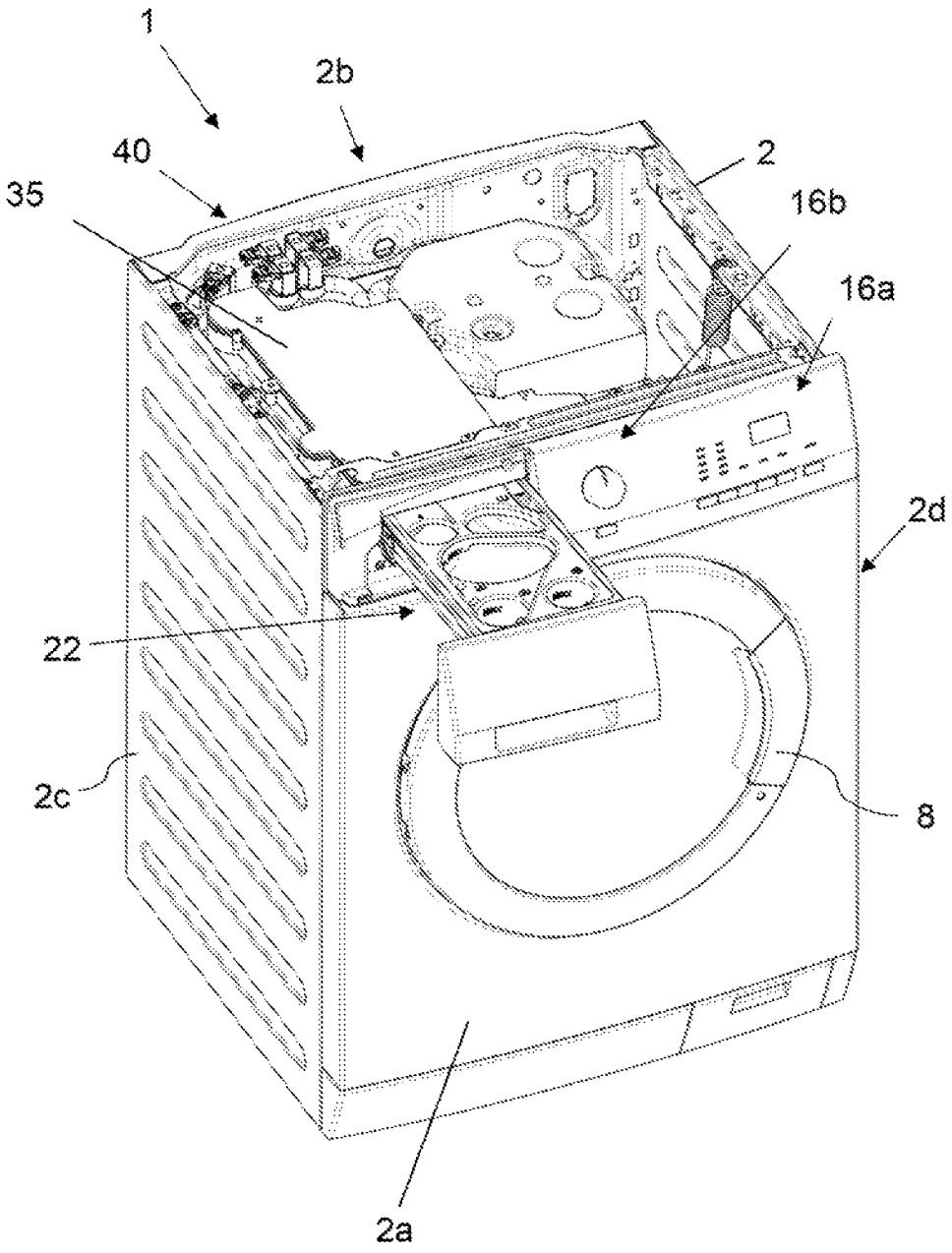
FIG. 3 shows the laundry washing machine of FIG. 2 in which the drawer of the treating agents dispenser is in a opened loading position.
Figure 4:
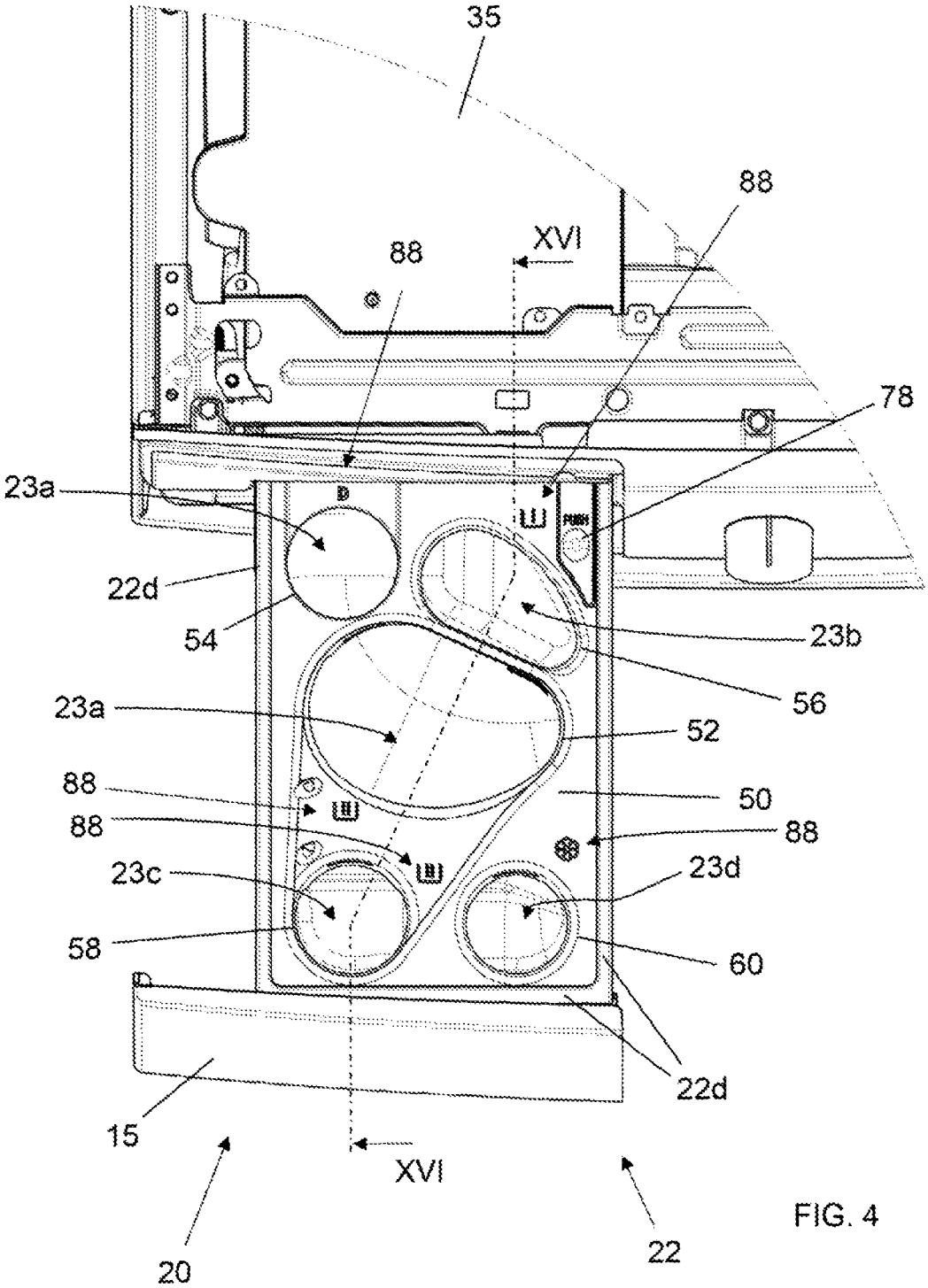
FIG. 4 is a plan top view of a detail of FIG. 3.
Figure 5:
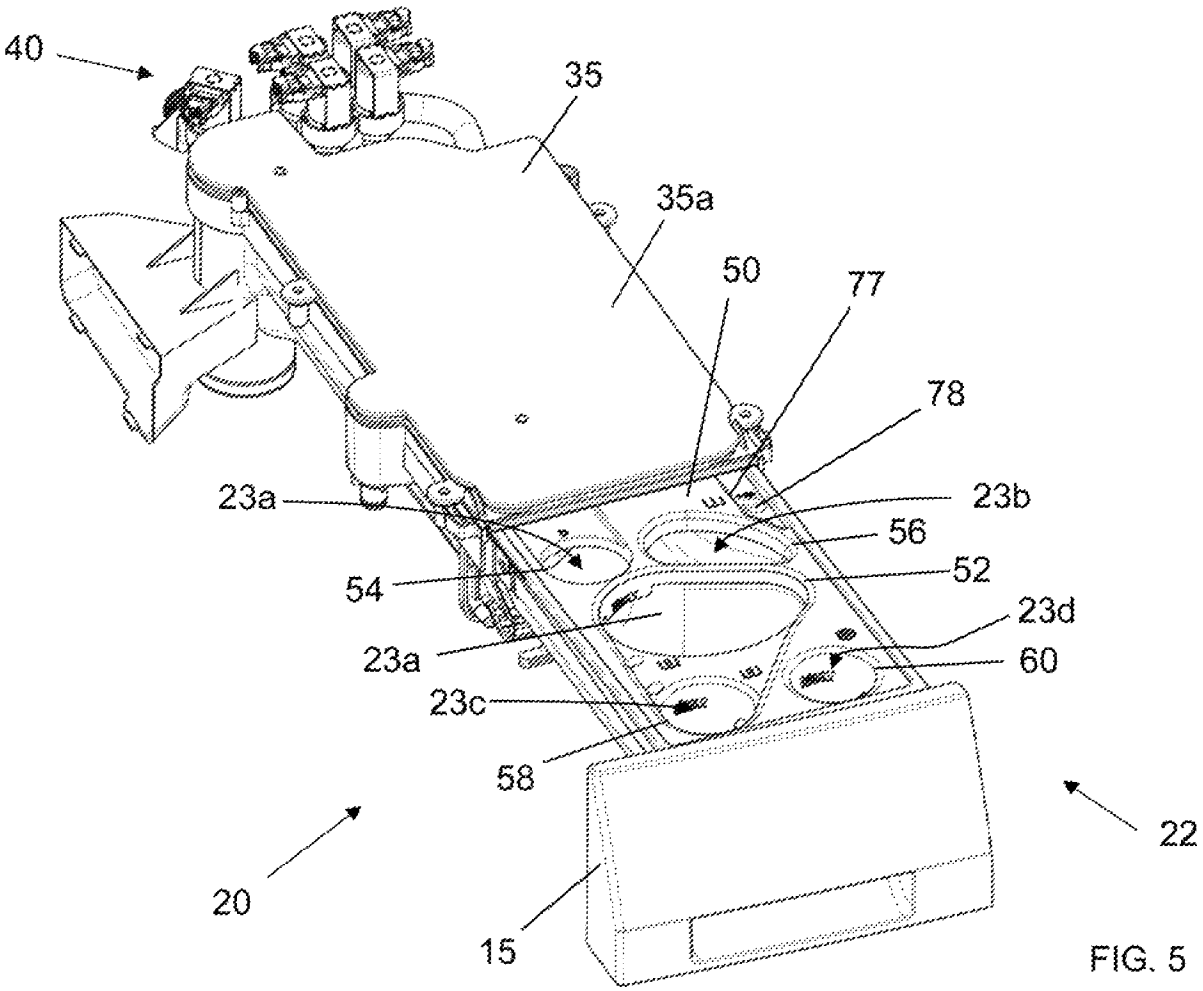
FIG. 5 shows the treating agents dispenser of FIG. 3 isolated from the rest.

The housing 21 is suited to receive a drawer 22, preferably a slidable drawer 22, which can be extracted from the housing 21, such as to protrude from the cabinet 2 in an opened position, as illustrated for example in FIGS. 3 and 4, or can be fully inserted into the housing 21 in a closed operational position, as illustrated in FIGS. 1 and 2.

The drawer 22 preferably comprises a front panel 15 associated to a frontal part of the drawer 22 and preferably has a handle by means of which the drawer 22 can be moved from the closed position and an opened position and, vice-versa, can be moved from the opened position to the closed position.

Figure 7A:
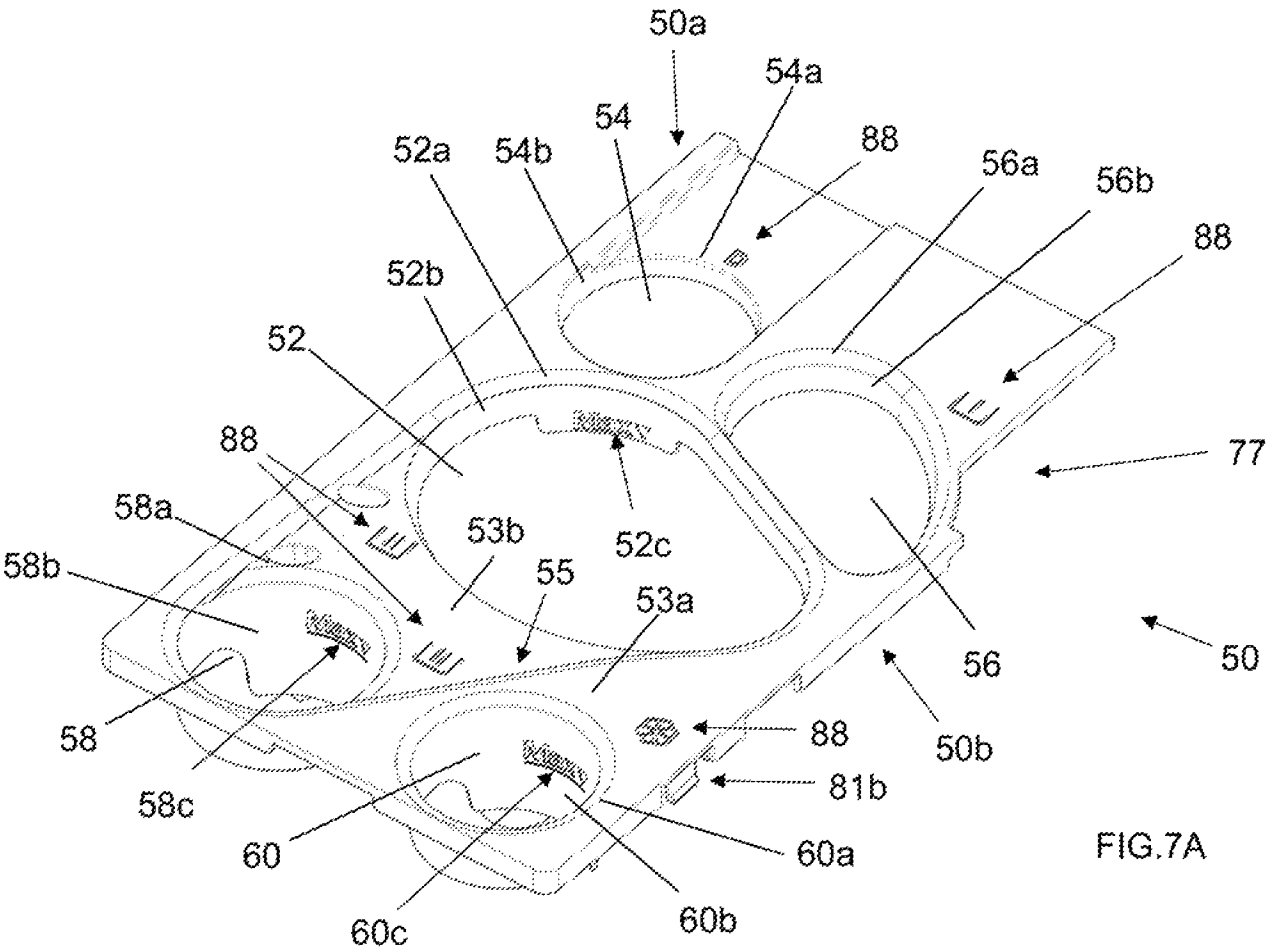
FIG. 7A shows the cover element of FIG. 6 isolated from the rest.
Figure 7B:
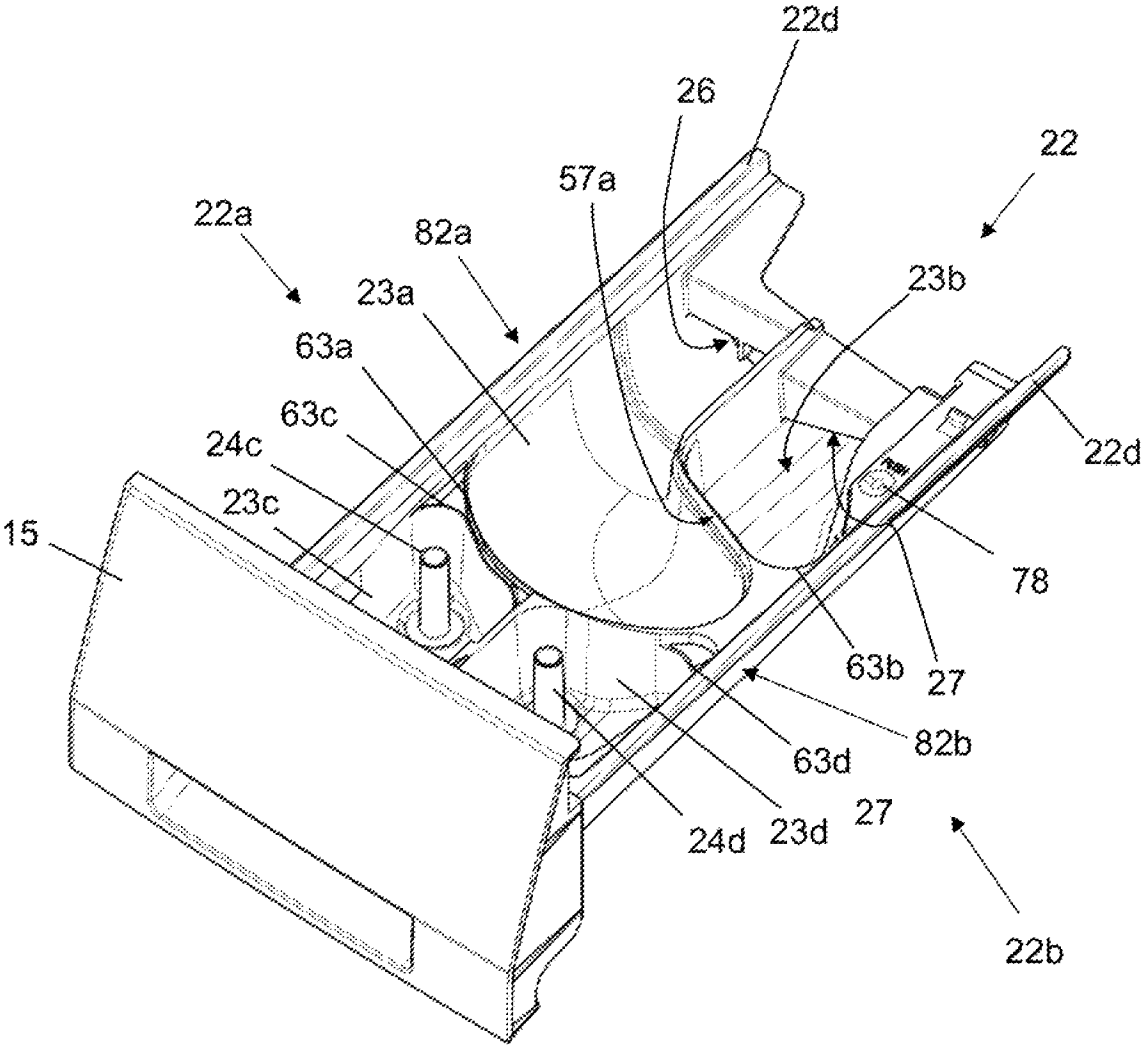
FIG. 7B shows the drawer of FIG. 6 isolated from the rest.

The drawer 22 preferably comprises an upper side 22*a* and an opposite underside 22*b*, as illustrated in FIG. 7B.

The drawer 22 is preferably provided with one or more compartments 23*a*, 23*b*, 23*c*, 23*d* adapted to be filled with treating agents.

The compartments 23*a*, 23*b*, 23*c*, 23*d* are preferably opened upwardly, i.e. open-top, to allow filling with treating agents from above.

Each compartment 23*a*, 23*b*, 23*c*, 23*d* preferably defines a respective top boundary line 63*a*, 63*b*, 63*c*, 63*d*.

In the embodiment illustrated in the Figures, there are four compartments, 23*a*, 23*b*, 23*c* and 23*d*.

In different embodiments, not illustrated, the number of compartments may be different, according to the desired type and number of treating agents which are used in the particular model of laundry washing machine.

The first compartment 23*a* is preferably adapted for receiving a powder detergent and/or a unit dose package, which is preferably used during a main wash phase of the selected washing cycle. The unit dose package comprises a pre-measured amount of treating agent incorporated into a water-soluble pouch, wherein the treating agent includes detergent. Hereinafter we will indicate said unit dose package simply with the term "pod".

The second compartment 23*b* is preferably adapted for receiving a quantity of a powder or liquid detergent which is preferably used during a pre-wash phase of the selected washing cycle; the third compartment 23*c* is preferably adapted for receiving a liquid detergent which is preferably used during a main wash phase of the selected washing cycle; the fourth compartment 23*d* is preferably adapted for receiving a liquid softener.

In different embodiments, other treating agents may be used, such as fabric conditioners, waterproofing agents, fabric enhancers, rinse sanitization additives, chlorine-based additives, etc.

The treating agents dispenser 20 further comprises a water distributor 35, associated to the housing 21 and placed above the drawer 22. The water distributor 35 preferably comprises an upper side 35*a* and an opposite underside 35*b*. The water distributor 35 is configured in such a way to allow the flowing of water to one or more of said compartments 23*a*, 23*b*, 23*c*, 23*d* when the drawer is placed in its closed operational position.

At this purpose, the water distributor 35 preferably comprises one or more channels, not shown, adapted for selectively conveying water to one or more of said compartments 23*a*, 23*b*, 23*c*, 23*d* of the drawer 22 when the latter is placed in its closed operational position.

At this purpose, the channels are provided with outlets (not shown) arranged on the underside 35*b* of the distributor 35 and facing the underlying compartments 23*a*, 23*b*, 23*c*, 23*d*. Outlets allow the passage of the water from the water distributor 35 to the underlying compartments 23*a*, 23*b*, 23*c*, 23*d*.

The water distributor 35 is apt to be connected to an external water source, which could comprise, for example, the plumbing of the building in which the laundry washing machine 1 is installed. The external water source is preferably a source for the adduction of cold water.

The water distributor 35 is preferably connected to the external water source by means of valves 40.

The first compartment 23*a* is preferably provided with an aperture 26 defined at the rear thereof, as illustrated in FIG. 7B. The aperture 26 is adapted to allow the flowing of a liquid therethrough and then to the bottom side 21*a* of the housing and the outlet port 21*d* to convey liquid to the supply pipe towards the tub.

The second compartment 23*b* is preferably provided with an aperture 27, preferably a horizontal slot, defined at the rear thereof. The slot 27 is adapted to allow the flowing of a liquid therethrough and then to the bottom side 21*a* of the housing 21 and the outlet port 21*d* to convey liquid to the supply pipe towards the tub.

The other compartments 23*c* and 23*d* of the drawer 22 are preferably provided with respective siphon tubes 24*c* and 24*d*.

The first siphon tube 24*c* connects the third compartment 23*c* to the underside 22*b* of the drawer 22 and the second siphon tube 24*d* connects the fourth compartment 23*d* to the underside 22*b* of the drawer 22.

Apertures 26, 27 and siphon tubes 24*c*, 24*d* define outlets apt to fluidly connecting a respective compartment 23*a*, 23*b*, 23*c* and 23*d* to the bottom side 21*a* of the housing 21 and the outlet port 21*d*.

According to an aspect of the invention, the treating agents dispenser 20 preferably comprises a cover element 50 which is arranged between the drawer 22 and the water distributor 35.

The cover element 50 preferably comprises an upper side 50*a* and an opposite underside 50*b*, as visible in FIG. 6. Preferably the upper side 50*a* of the cover element 50 faces the underside 35*b* of the water distributor 35 and the underside 50*b* of the cover element 50 faces the upper side 22*a* of the drawer 22.

Preferably, as illustrated in FIGS. 4 and 7B, the drawer 22 comprises a border rim 22*d* which substantially externally delimits the compartments 23*a*, 23*b*, 23*c* and 23*d*. In the preferred embodiment here illustrated, the border rim 22*d* preferably extends along front and lateral sides of drawer 22 while it is omitted on the rear side of the drawer 22.

In different embodiments, the border rim may also extend along the rear side of the drawer so as to realize a closed border.

Preferably, the cover element 50 peripherally borders the border rim 22*d*.

Preferably, the size of the cover element 50 is substantially equal to the size of the drawer 22.

Preferably, the width of the cover element 50 is substantially equal to the width of the drawer 22.

Preferably, the length of the cover element 50 is substantially equal to the length of the drawer 22.

More preferably, the cover element 50 has a length so that it is partially inserted in the housing 21 when the drawer 22 is in its maximum opened position.

In particular, the length of the cover element 50 is sufficient to cover the drawer 22 when the drawer 22 is in its maximum opened position, as illustrated for example in FIG. 4. In said opened position the rear part of the cover element 50 is advantageously partially inserted in the housing 21 and hides the underlying rear part of the drawer 22.

The cover element 50 preferably comprises apertures 52, 54, 56, 58, 60 positioned above the compartments 23*a*, 23*b*, 23*c* and 23*d*.

In the first preferred embodiment here illustrated, there are five apertures 52, 54, 56, 58, 60.

In different embodiments; as for example illustrated and described later, the number of apertures may be different, according to the desired type and number of treating agents which are used in the particular model of laundry washing machine.

The cover element 50 according to the invention is apt to be positioned above the drawer 22 and slides therewith.

In the first embodiment here illustrated, the first and second apertures 52, 54, are positioned above the first compartment 23*a*, the third aperture 56 is positioned above the second compartment 23*b*, the fourth aperture 58 is positioned above the third compartment 23*c* and the fifth aperture 60 is positioned above the fourth compartment 23*d*.

According to an aspect of the invention, the first aperture 52 is preferably used to introduce powder detergent in the first compartment 23*a*. The second aperture 54 is preferably used to introduce a pod in the first compartment 23*a*.

Advantageously, the user may fill the first compartment 23*a* through the first aperture 52 with powder detergent and/or may insert a pod in the first compartment 23*a* through the second aperture 54. Accordingly, during the main wash phase of the selected washing cycle, the powder detergent and/or the pod will be conveyed to the washing tub by means of water coming from the distributor 35 into the first compartment 23*a* passing through the first 52 and/or the second 54 aperture.

The two apertures 52, 54 above the first compartment 23*a* advantageously define respective correct positions where the powder detergent or the pod is placed by the user inside the first compartment 23*a*.

In particular, the first aperture 52 preferably defines positioning of the powder detergent centrally in the first compartment 23*a* and the second aperture 54 advantageously defines positioning of the pod rearward in the first compartment 23*a*.

Said positions defined by the first aperture 52 and/or the second aperture 54 preferably correspond to the best positions for the powder detergent or the pod along the direction of the water falling into the compartments from outlets of the channels on the underside 35*b* of the distributor 35.

Correct positioning of the powder detergent or of the pod in the first compartment 23*a* assure that all, or almost all, the treating agent (detergent) is drawn through the aperture 26 into the washing tub by the water falling down from the distributor 35. Advantageously, no products accumulate at side walls of the first compartment 23*a*. This guarantees good hygienic conditions inside the first compartment 23*a*, in particular when the laundry washing machine 1 in not used for a long time between two successive washing cycles.

The third aperture 56 is preferably used to introduce powder or liquid detergent which is preferably used during a pre-wash phase of the selected washing cycle.

Advantageously, the user may fill the second compartment 23*b* through the third aperture 56.

The fourth aperture 58 is preferably used to introduce liquid detergent which is preferably used during a main wash phase of the selected washing cycle.

Advantageously, the user may fill the third compartment 23*c* through the fourth aperture 58.

The fifth aperture 60 is preferably used to introduce liquid softener which is preferably used during a phase of the selected washing cycle.

Advantageously, the user may fill the fourth compartment 23*d* through the fifth aperture 60.

The apertures 56, 58, 60 above the second, third and fourth compartments 23*b*, 23*c*, 23*d* advantageously define respective best positions for the water falling into the compartments from outlets of the channels on the underside 35*b* of the distributor 35.

Water falling down from the distributor 35 determines the best mixing action with the agent into the respective compartment.

Furthermore, advantageously, no products accumulate at side walls of the compartment. This guarantees good hygienic conditions inside the compartment, in particular when the laundry washing machine 1 in not used for a long time between two successive washing cycles.

The first aperture 52 is opportunely shaped so as to define a boundary line 52*a*.

Also second, third, fourth and fifth aperture 54, 56, 58, 60 are opportunely shaped so as to define a boundary line 54*a*, 56*a*, 58*a*, 60*a*.

According to an aspect of the invention, the boundary line 52*a* of the first aperture 52 is preferably smaller than the boundary line 63*a* of first compartment 23*a*, that is to say that the size of the first aperture 52 is preferably smaller than the size of first compartment 23*a*.

Also, preferably, the boundary line 54*a* of the second aperture 54 is smaller than the boundary line 63*a* of first compartment 23*a*, that is to say that the size of the second aperture 54 is smaller than the size of first compartment 23*a*.

Analogously, and preferably, the boundary lines 56*a*, 58*a*, 60*a* of the third, fourth and fifth apertures 56, 58, 60 are smaller than the boundary line 63*b*, 63*c* and 63*d* of the second, third and fourth compartment 23*b*, 23*c*, 23*d*, that is to say that the size of the third, fourth and fifth apertures 56, 58, 60 is smaller than the size of the respective underlying compartment 23*b*, 23*c*, 23*d*, Preferably, the boundary line 52*a*, 54*a*, 56*a*, 58*a*, 60*a* of the respective aperture 52, 54, 56, 58, 60 follows, when possible, the boundary line 63*a*, 63*b*, 63*c*, 63*d*. of the underlying compartment 23*a*, 23*b*, 23*c*, 23*d*.

Advantageously, when water is flushed from the distributor 35 into the compartment 23*a*, 23*b*, 23*c*, 23*d* through the aperture 52, 54, 56, 58, 60 the treating agent does not accumulate on the underside 50*b* of the cover element 50. This again guarantees good hygienic conditions.

For example, most part of the boundary line 52*a* of the first aperture 52 follows the boundary line 63*a* of the underlying first compartment 23*a*.

Advantageously, when water is flushed from the distributor 35 into the first compartment 23*a* through the first aperture 52, the power detergent does not accumulate on the underside 50*b* of the cover element 50.

Preferably the first aperture 52 comprises a rim 52*b* extending downwardly from the boundary line 52*a*. More preferably, the rim 52*b* extends all around the first aperture 52.

Also, preferably, second, third, fourth and fifth apertures 54, 56, 58, 60 each comprises a rim 54*b*, 56*b*, 58*b*, 60*b* extending downwardly from the respective boundary line 54*a*, 56*a*, 58*a*, 60*a*. More preferably, the rim 54*b*, 56*b*, 58*b*, 60*b* extends all around the aperture 54, 56, 58, 60.

Figure 16:
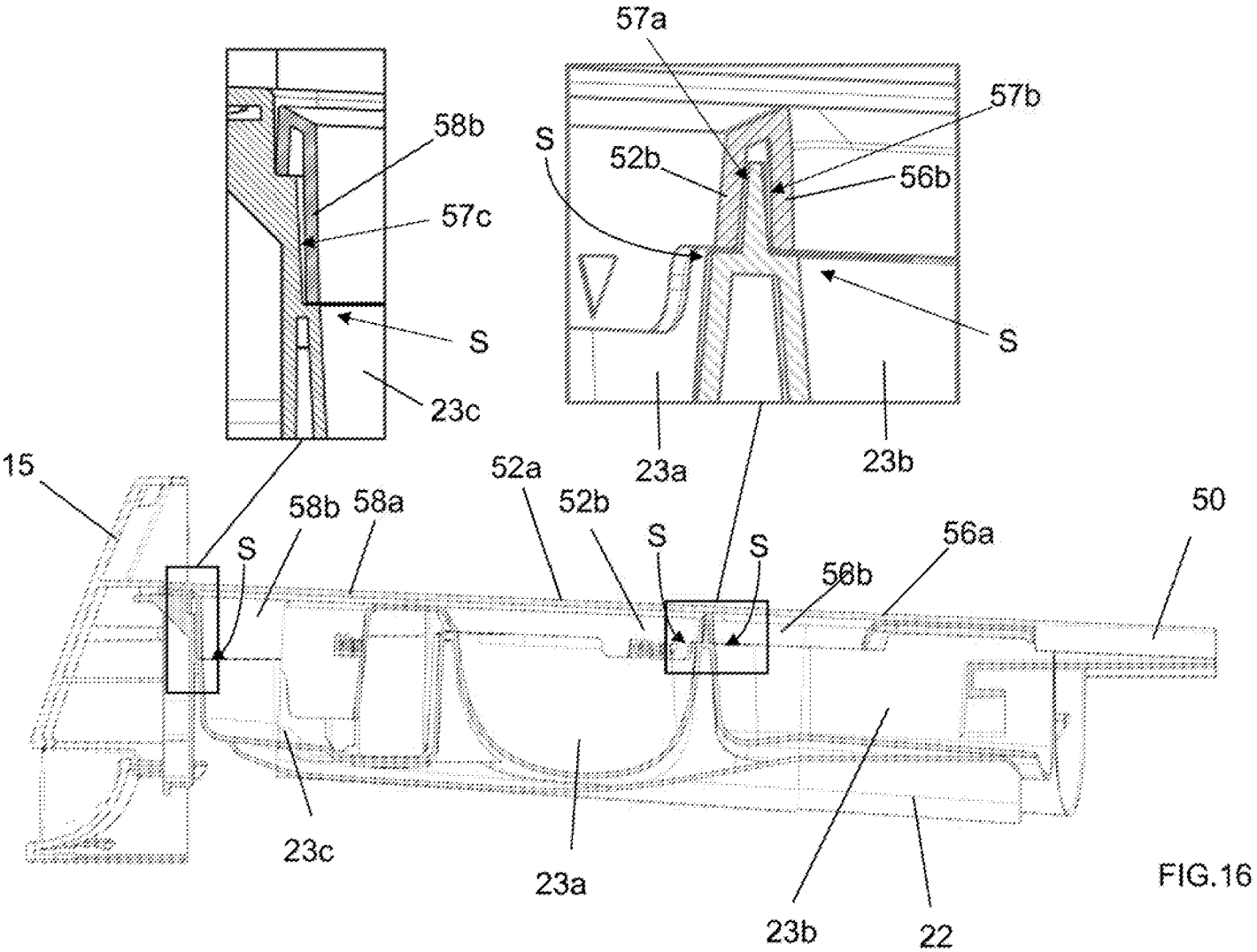
FIG. 16 is a plan sectional view taken along line XVI-XVI of FIG. 4.

Preferably, where the boundary line of the aperture follows the boundary line of the underlying compartment, as said above, the rim 52*b*, 56*b*, 58*b* is preferably received in a corresponding recess 57*a*, 57*b*, 57*c* of the underlying compartment 23*a*, 23*b*, 23*c* (as depicted in FIG. 16 in particular with reference to compartments 23*a*, 23*b*, 23*c*). More preferably, the recess 57*a*, 57*b*, 57*c* is defined at the upper part of lateral side walls of the compartment 23*a*, 23*b*, 23*c*.

Advantageously, the adjoining surfaces of the cover element 50 and the compartment 23*a*, 23*b*, 23*c* are flush, as indicated with "S" in FIG. 16, and treating agent does not accumulated between them. This further guarantees good hygienic conditions.

According to an aspect of the invention, the rim is used as level indicator for indicating the level of the treating agent introduced in the underlying compartment.

In a preferred embodiment, the level indicator indicates the maximum level of treating agent that should be introduced in the underlying compartment.

In different preferred embodiments, not illustrated, the level indicator may indicate the level of treating agent introduced in the underlying compartment, for example a minimum and/or a medium level.

In a preferred embodiment, the level indicator corresponds to the lower edge of the rim, as it happens for the lower edge 52*c* of the rim 52*b* of the first aperture 52*a*.

In a further preferred embodiment, the level indicator comprises a line realized in the rim of the aperture, as it happens for the rim 58*b*, 60*b* of the fourth and fifth apertures 58, 60 where a line 58*c*, 60*c* indicates the maximum level of treating agent that should be introduced in the underlying compartment 23*c*, 23*d*.

According to an aspect of the invention, the cover element 50 is movably associated to the upper side 22*a* of the drawer 22. Preferably the cover element 50 is removably associated to the upper side 22*a* of the drawer 22.

A release device allows the cover element 50 to be releasably connected to the upper side 22*a* of the drawer 22.

The release device preferably comprises elastic tongues 81*a*, 81*b* at lateral sides of the cover element 50 which are suitable to abut against side walls portions 82*a*, 82*b* of the drawer 22.

Advantageously, the cover element 50 may be easily removed from the drawer 22 and then easily cleaned by the user, for example by flushing with water or by rubbing with a cloth.

Accumulation of residues of treating agents is therefore prevented. This guarantees good hygienic conditions of the cover element 50 and of the treating agents dispenser 20, in particular when the laundry washing machine 1 in not used for a long time between two successive washing cycles.

Figure 8:
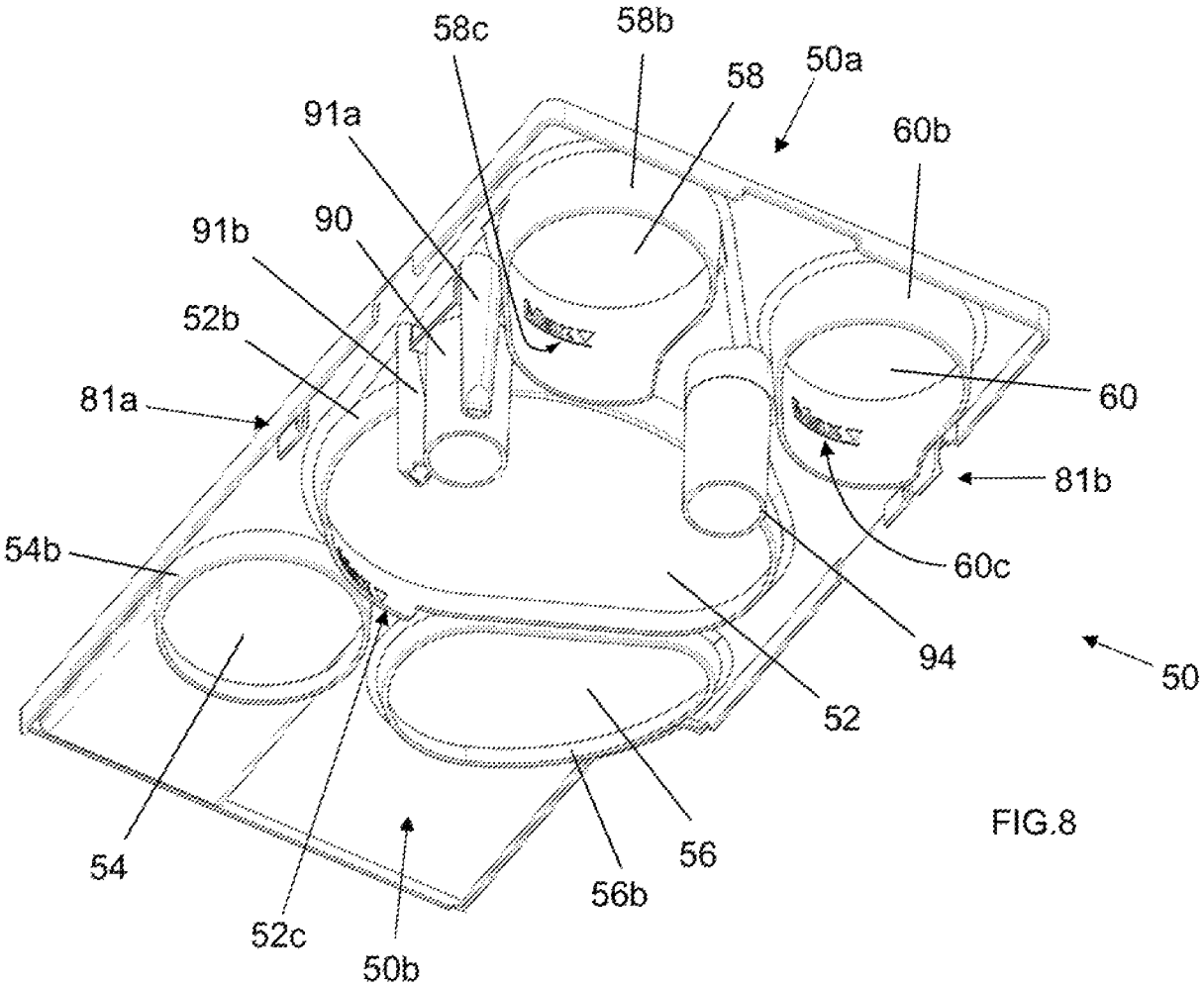
FIG. 8 shows the cover element of FIG. 7A from below.
Figure 9:
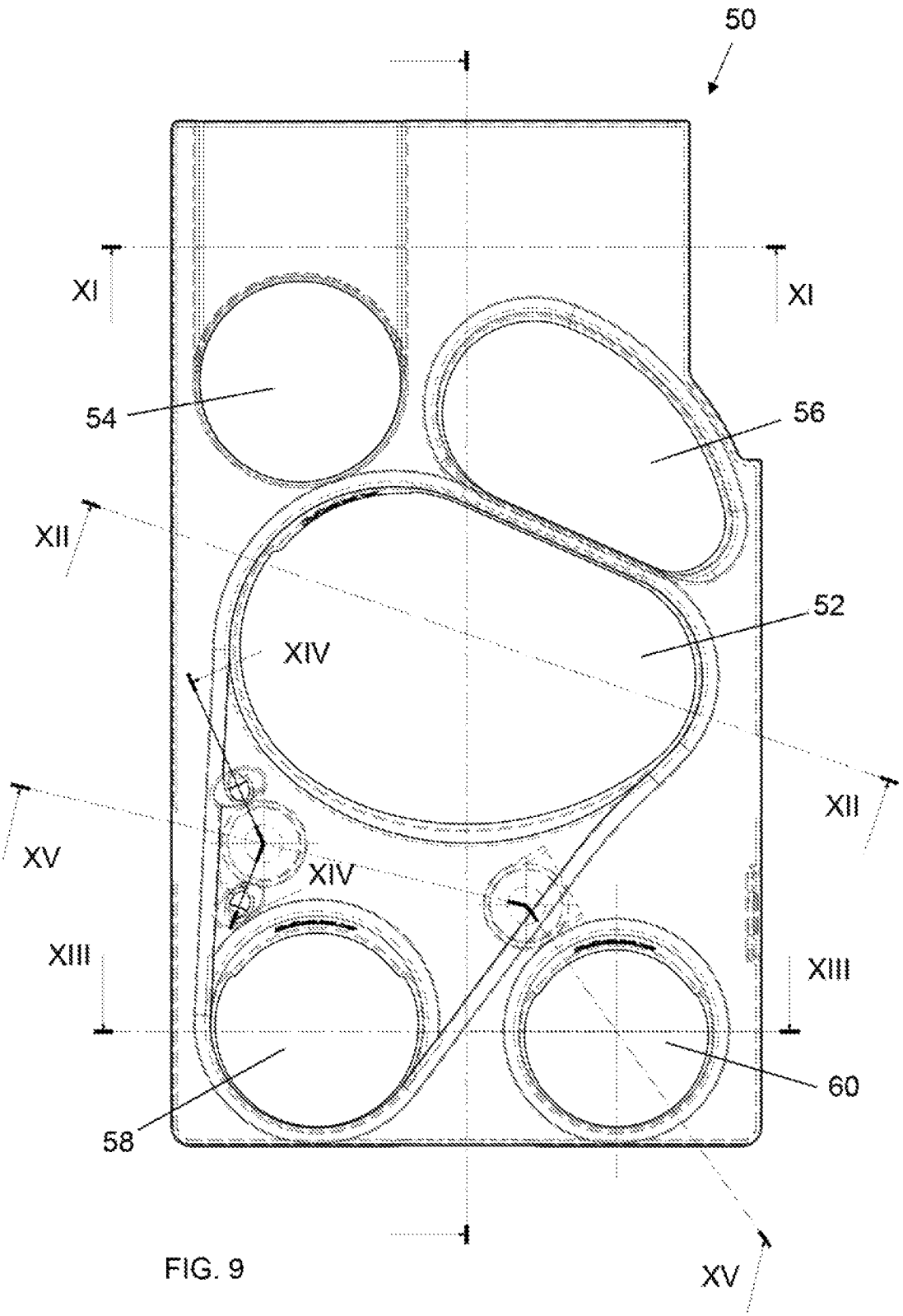
FIG. 9 is a plan top view of the cover element FIG. 7A.

The underside 50*b* of the cover element 50, as illustrated in FIG. 8, preferably comprises a first siphon cap 90 and a second siphon cap 94. The first siphon cap 90 is positioned over the siphon tube 24*c* of the third compartment 23*c* when the cover element 50 is arranged over the drawer 35. The second siphon cap 94 is positioned over the siphon tube 24*d* of the fourth compartment 23*d* when the cover element 50 is arranged over the drawer 35.

The third compartment 23*c* and the fourth compartment 23*d* are used to hold and dispense liquid agents (a liquid detergent and a liquid softener, respectively).

The third compartment 23*c* is preferably adapted for receiving a liquid detergent which is preferably used during a main wash phase of the selected washing cycle bleach; the fourth compartment 23*d* is preferably adapted for receiving a liquid softener.

In operation, a user pours said liquid agents into compartments 23*c* and 23*d* through apertures 58, 60.

During appropriate times in the washing cycle, water is introduced into the third compartment 23*c* (through fourth aperture 58) and into the fourth aperture 23*d* (through fifth aperture 60).

As water is added to the third compartment 23*c* and the liquid level rises above the top of siphon tube 23*c*, a siphoning effect occurs. This siphon effect then draws liquid from the third compartment 23*c* and releases that liquid to the bottom side 21*a* of the housing 21 and the outlet port 21*d* to convey liquid to the supply pipe towards the tub.

Analogously, during appropriate times in the washing cycle, as water is added to the fourth compartment 23*d* and the liquid level rises above the top of siphon tube 24*c*, a siphoning effect occurs. This siphon effect then draws liquid from the fourth compartment 23*d* and releases that liquid to the bottom side 21*a* of the housing 21 and the outlet port 21*d* to convey liquid to the supply pipe towards the tub.

Figure 14:
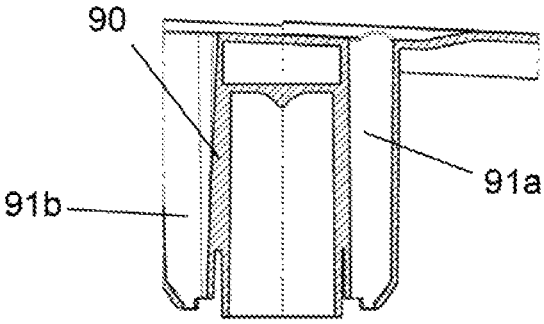
FIG. 14 is a plan sectional view taken along line XIV-XIV of FIG. 9.
Figure 15:
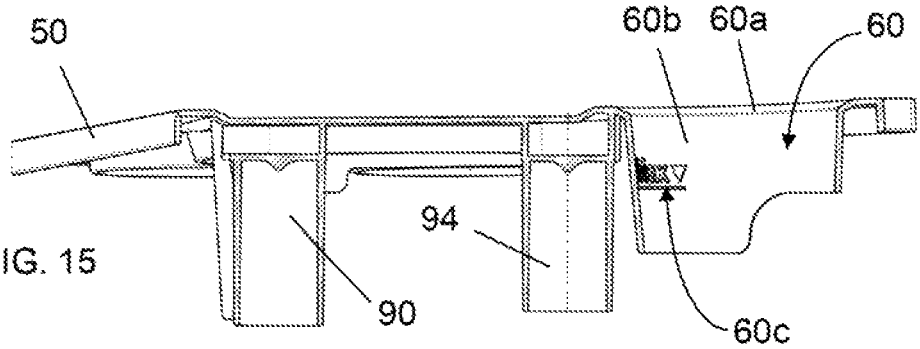
FIG. 15 is a plan sectional view taken along line XV-XV of FIG. 9.

The first siphon cap 90 is preferably further provided with two lateral inflow tubes 91*a*, 91*b*, as depicted in FIG. 14. The tubes 91*a*, 91*b* extend substantially parallel to the siphon cap 90 and have a substantially equal length. The open ends 92*a*, 92*b* of inflow tubes 91*a*, 91*b* are angled on one side, so as to direct the inflow of water towards the base of the siphon tube/cap assembly. This arrangement is used to increase the velocity of the water output from open ends 92*a*, 92*b*.

The use of inflow tubes 91*a*, 91*b* allows for treating agent (detergent or softener) to be diluted more effectively. In addition, the inflow tubes 91*a*, 91*b* can be used to prevent/remove agent buildup at the base of the siphon tub/cap assembly. This helps ensure reliable siphon action with repeated use over time.

The first siphon cap 90 and/or the second siphon cap 94 and/or the inflow tubes 91*a*, 91*b* are preferably integrally made with the cover element 50, more preferably by injection moulding of a plastic material.

The upper side 50*a* of the cover element 50 is preferably substantially flat and the apertures are preferably realized on the same horizontal surface.

In preferred embodiments, the apertures may be realized in surfaces arranged at different levels. Preferably, one aperture may be realized in a substantially flat surface arranged at a higher level with respect to the adjacent surfaces, where other apertures are realized.

In the preferred embodiment here illustrated, for example, the fifth aperture 60 is preferably realized in a flat surface 53*a* which is at a higher level with respect to the adjacent surface 53*b* where the first 52 and fourth 58 apertures are realized.

The levels difference between said surfaces 53*a*, 53*b* defines a small protective barrier 55 which prevents the overflow of water from adjacent surfaces.

This feature is particularly advantageous since it avoids the siphon taking hold prior to the desired dispensing time if water accidentally flow inside the fifth aperture 60. This may happen, for example, when the drawer 22 is extracted from the housing 21 after the initial filling of treating agents in the compartments.

Overflow of water in the fifth aperture 60 may cause a siphoning effect and softener delivery in advance with respect to the expected time for the softening phase, which is usually one of the latest phase of the washing cycle.

While in the preferred embodiment here illustrated and described the protective barrier is obtained with surfaces realized at different levels, in different embodiments the protective barrier may be differently realized, for example through a protruding rib from the upper side flat surface of the cover element.

Figure 10:
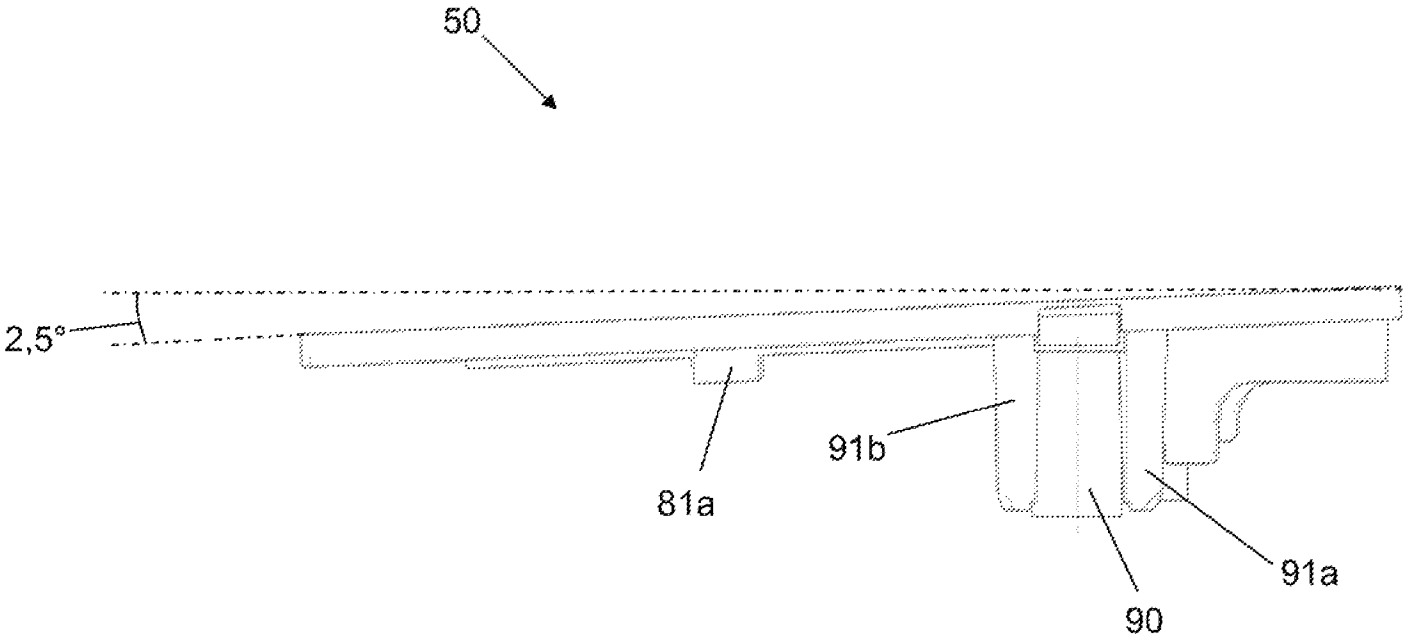
FIG. 10 is a plan lateral view of the cover element 7A.
Figure 11:
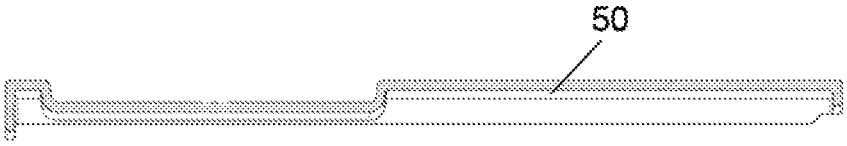
FIG. 11 is a plan sectional view taken along line XI-XI of FIG. 9.
Figure 12:
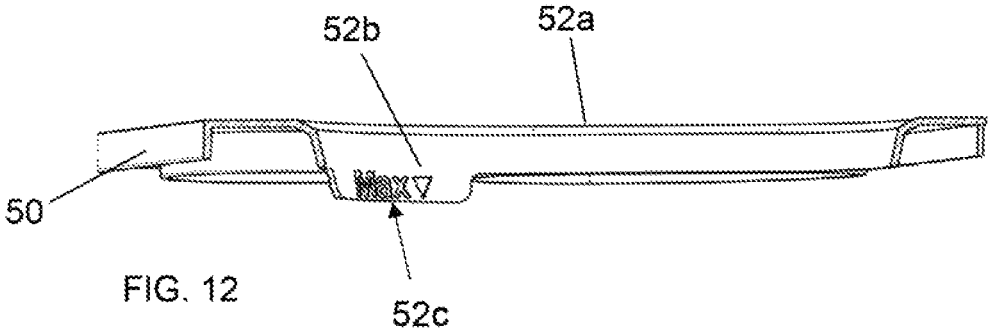
FIG. 12 is a plan sectional view taken along line XII-XII of FIG. 9.
Figure 13:
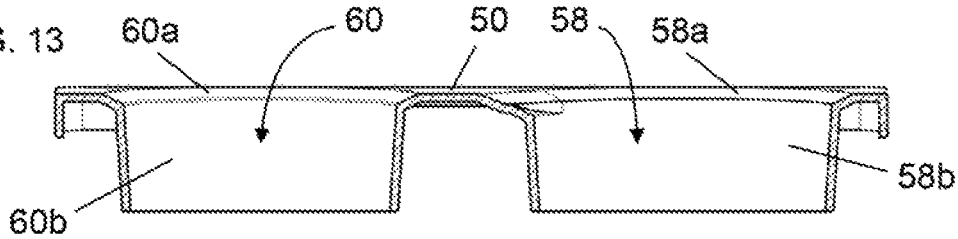
FIG. 13 is a plan sectional view taken along line XIII-XIII of FIG. 9.

According to another aspect, the upper side 50*a* of the cover element 50 is slightly inclined, for example 2.5° as shown in FIG. 10, with respect to the horizontal plane when the treating agents dispenser is mounted in an operational position.

In this way, the upper side 50*a* of the cover element 50 is provided with a ramp sloping down towards the rear side of the drawer 22 and of the housing 21. In case water falls on the upper side 50*a* of the cover element 50 it may flow towards the rear side of the drawer 22 and in particular towards the outlet port 21*d* of the housing 21 and, from there, into the supply pipe up to the tub.

The upper side 50*a* of the cover element 50 then preferably comprises one or more symbols and/or texts 88 positioned close to the compartments 23*a*, 23*b*, 23*c*, 23*d* to indicate the correct treating agent that has to be inserted in the compartments 23*a*, 23*b*, 23*c*, 23*d*.

The cover element 50 then preferably comprises a recess 77 which allows a button 78, preferably a push button, to be easily reached by the user.

The button 78 is advantageously actuated by the user in order to completely remove the drawer 22 from the housing 21.

A device comprising a button to completely remove the drawer from the housing is well known in the art and therefore it will not be described in detail.

Figure 17:
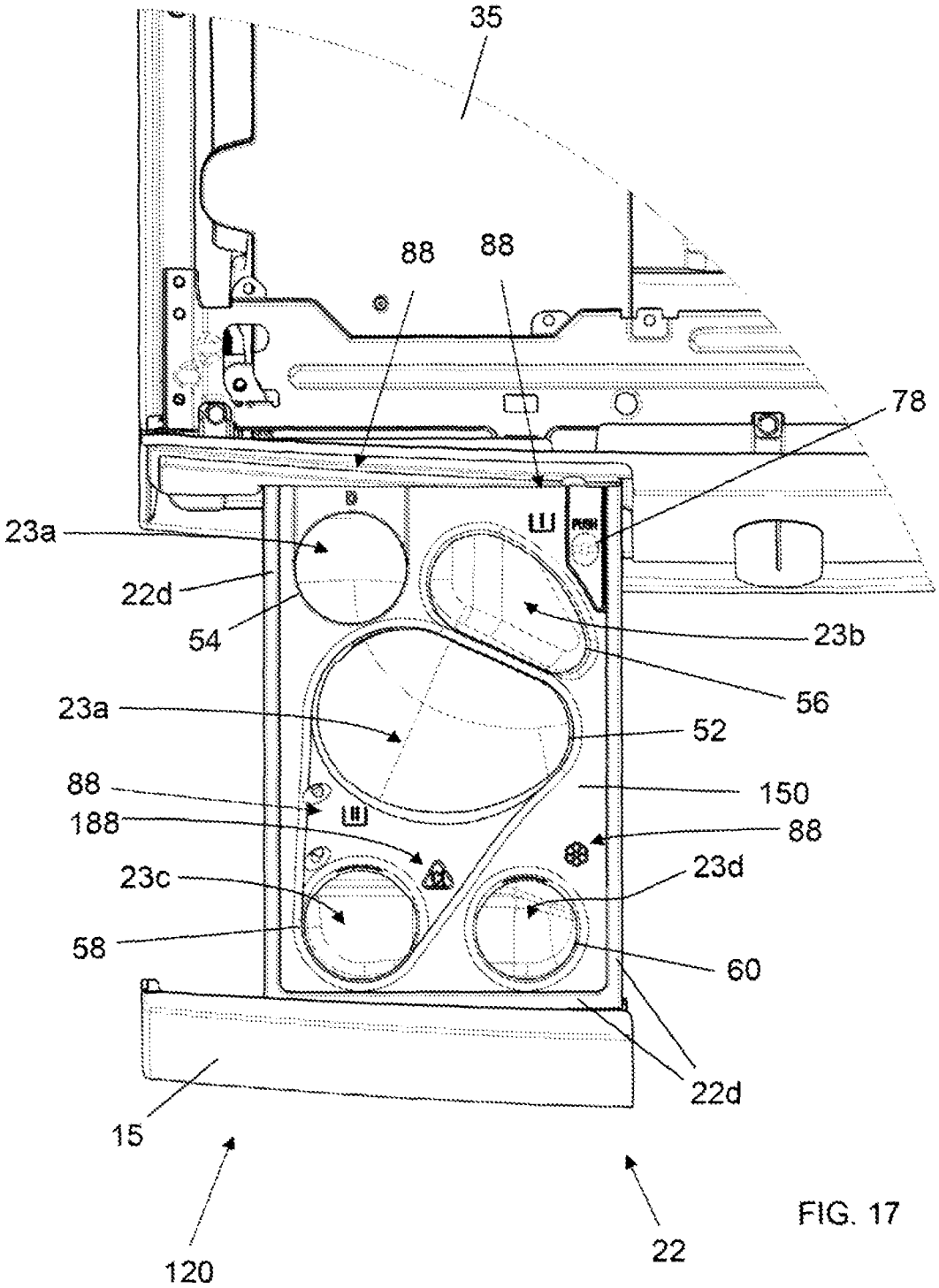
FIG. 17 shows a further preferred embodiment of the treating agents dispenser of FIG. 4.
Figure 18:
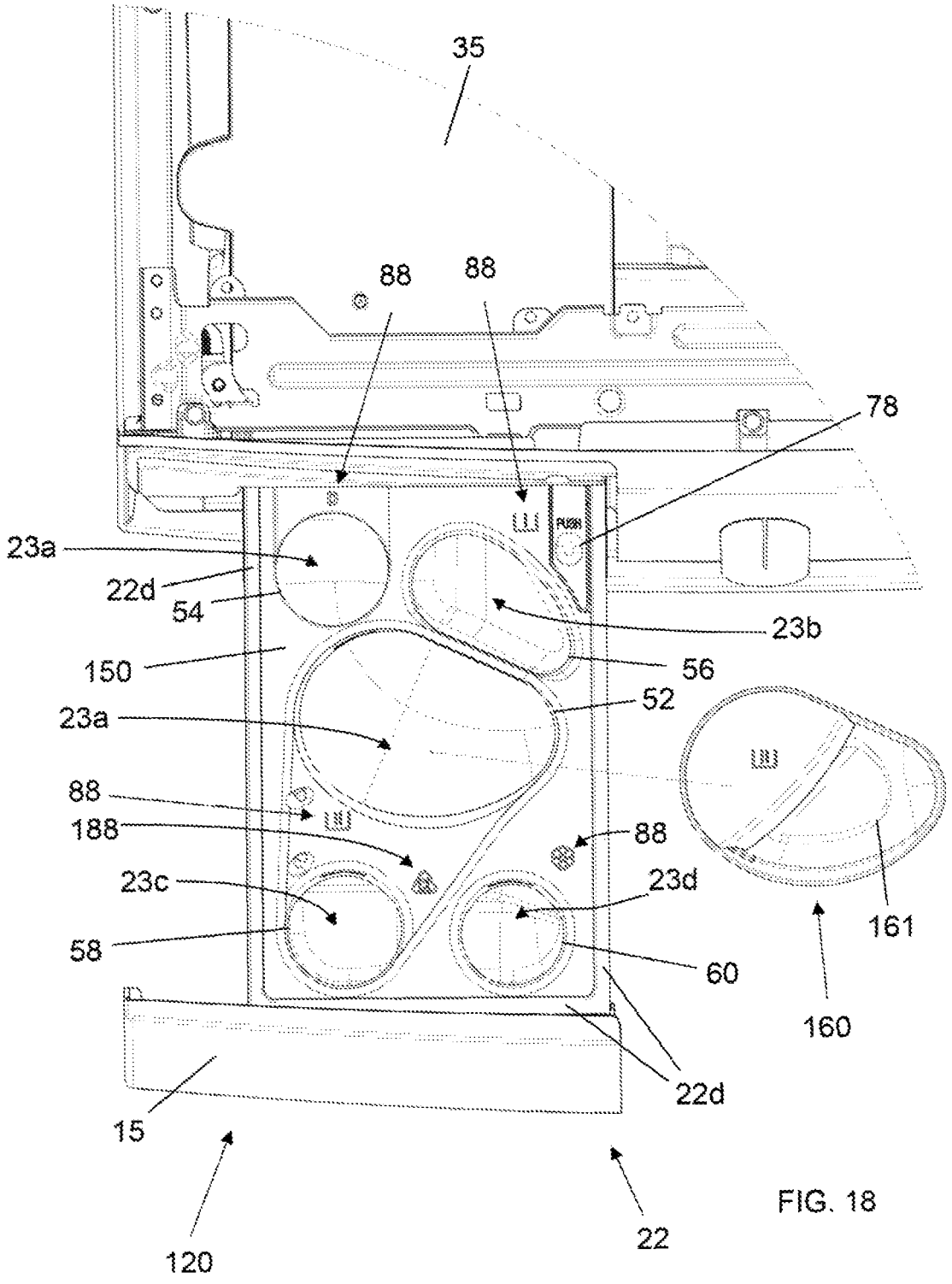
FIG. 18 shows the treating agents dispenser of FIG. 17 and an auxiliary liquid detergent container.
Figure 19:
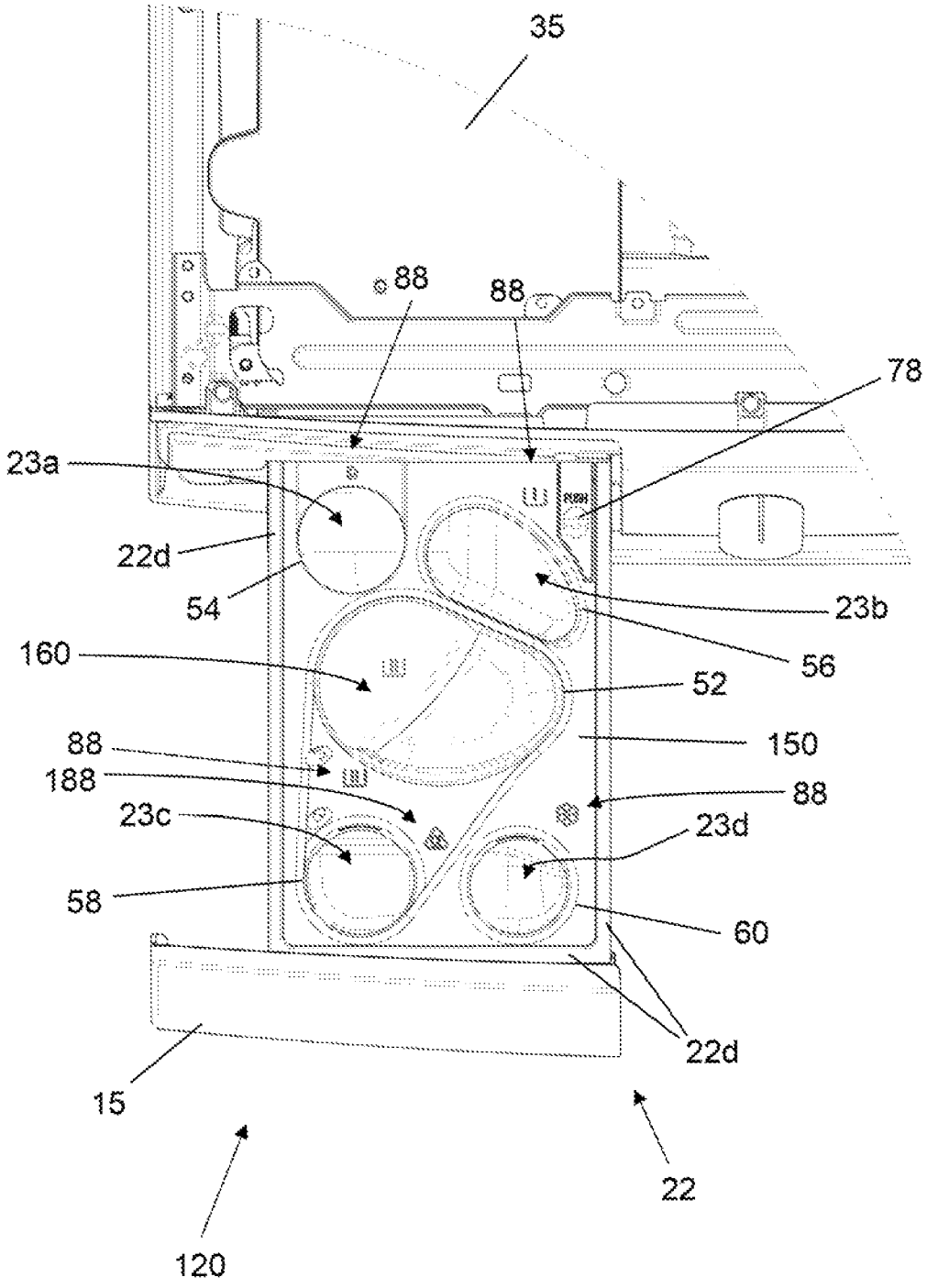
FIG. 19 shows the treating agents dispenser of FIG. 18 with the auxiliary liquid detergent container inserted therein.

With reference to FIGS. 17 to 19 a treating agents dispenser 120 according to a further preferred embodiment of the invention is described.

The treating agents dispenser 120 differs from the treating agents dispenser 20 previously described with reference to FIGS. 1 to 16 in that the cover element 150 is characterized by a different symbol 188 positioned close to the third compartment 23*c* to indicate the correct treating agent that has to be inserted in the third compartment 23*c*.

The first compartment 23*a* is still preferably adapted for receiving a powder detergent and/or a unit dose package, which is preferably used during a main wash phase of the selected washing cycle; the second compartment 23*b* is still preferably adapted for receiving a quantity of a powder or liquid detergent which is preferably used during a pre-wash phase of the selected washing cycle; the third compartment 23*c* is preferably adapted for receiving bleach; the fourth compartment 23*d* is still preferably adapted for receiving a liquid softener.

In different preferred embodiments, the third compartment is preferably adapted for receiving a liquid softener and the fourth compartment is preferably adapted for receiving bleach.

The drawer 22 underlying the cover element 150 is preferably the same above described with reference to FIGS. 1 to 16.

This embodiment, therefore, does not provide for a compartment for receiving a liquid detergent usable during a main wash phase of the selected washing cycle.

At this purpose, preferably, the treating agents dispenser 120 and, in particular, the first aperture 52 associated to the first compartment 23*a*, is suitable to receive an auxiliary stand-alone liquid detergent container 160, as illustrated in FIGS. 18 and 19. The liquid detergent container 160 is capable to store a given amount of liquid detergent product, and is properly dimensioned for being inserted in easy-removable manner into the first aperture 52. Liquid detergent container 160 preferably comprises a standalone basin 161 which is dimensioned for being inserted in easy-removable manner into the first aperture 52, and is provided with a syphon assembly (not shown) which is housed into basin 161 for draining out of basin 161 the liquid detergent stored in the latter when a given amount of water is channeled into the first compartment 23*a* through the water distributor 35, preferably in the main washing phase of the washing cycle.

The treating agents dispenser 120 may therefore be used either for receiving a powder detergent or a liquid detergent, in the latter case by using an auxiliary stand-alone liquid detergent container 160, as illustrated in FIG. 19.

Figure 20:
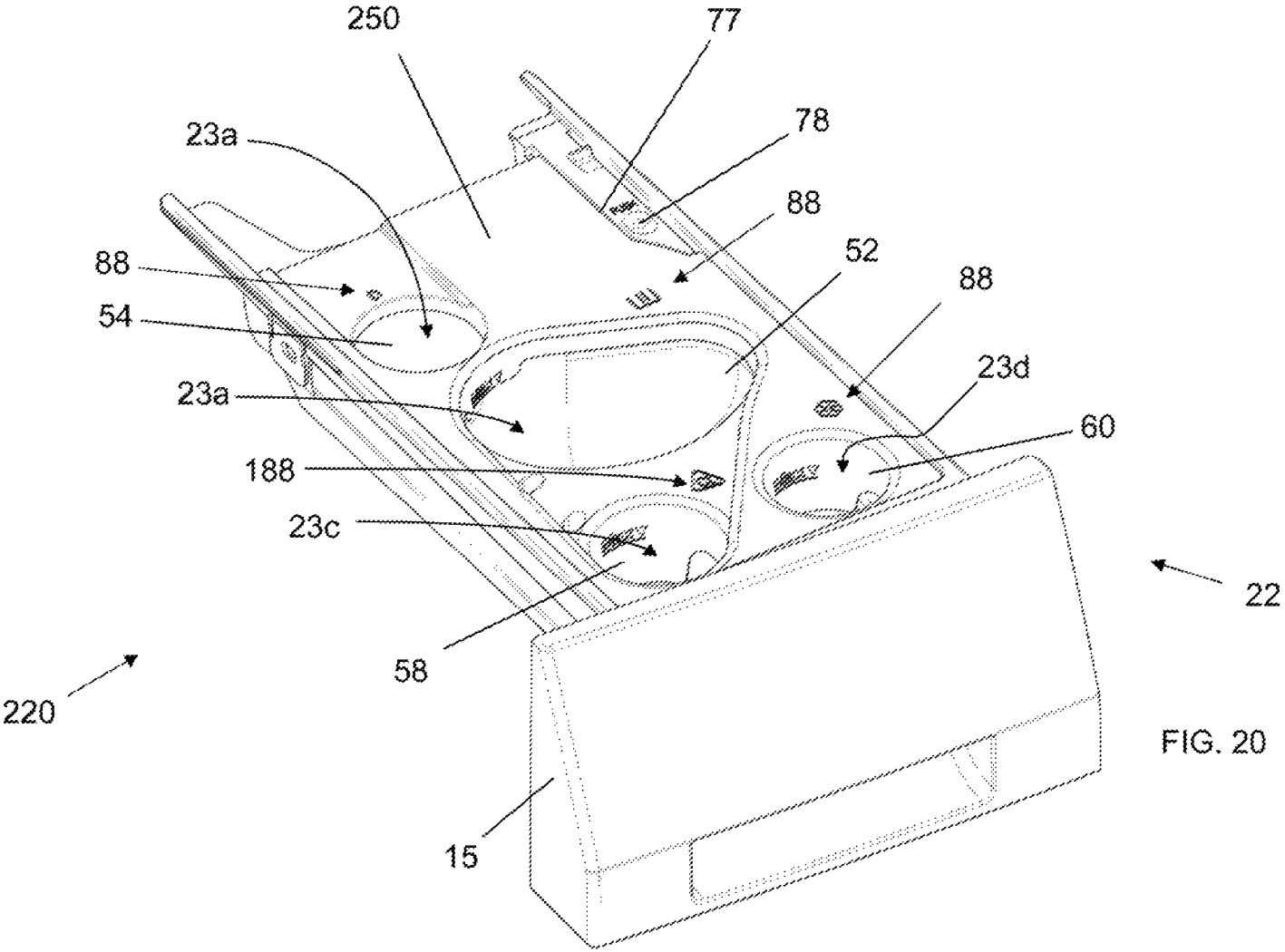
FIG. 20 shows a cover element according to a further preferred embodiment of the invention associated to a drawer.

With reference to FIG. 20 a treating agents dispenser 220, without water dispenser, according to a further preferred embodiment of the invention is described.

The treating agents dispenser 220 differs from the treating agents dispenser 120 previously described with reference to FIGS. 17 to 19 in that the cover element 250 does not provide for the third aperture 56.

In this preferred embodiment, the washing cycle does not comprise a pre-wash phase.

The drawer 22 underlying the cover element 250 may be the same above described with reference to previous embodiments.

In different embodiments, the second compartment of the drawer, of the type previously described, may be omitted.

Figure 21:
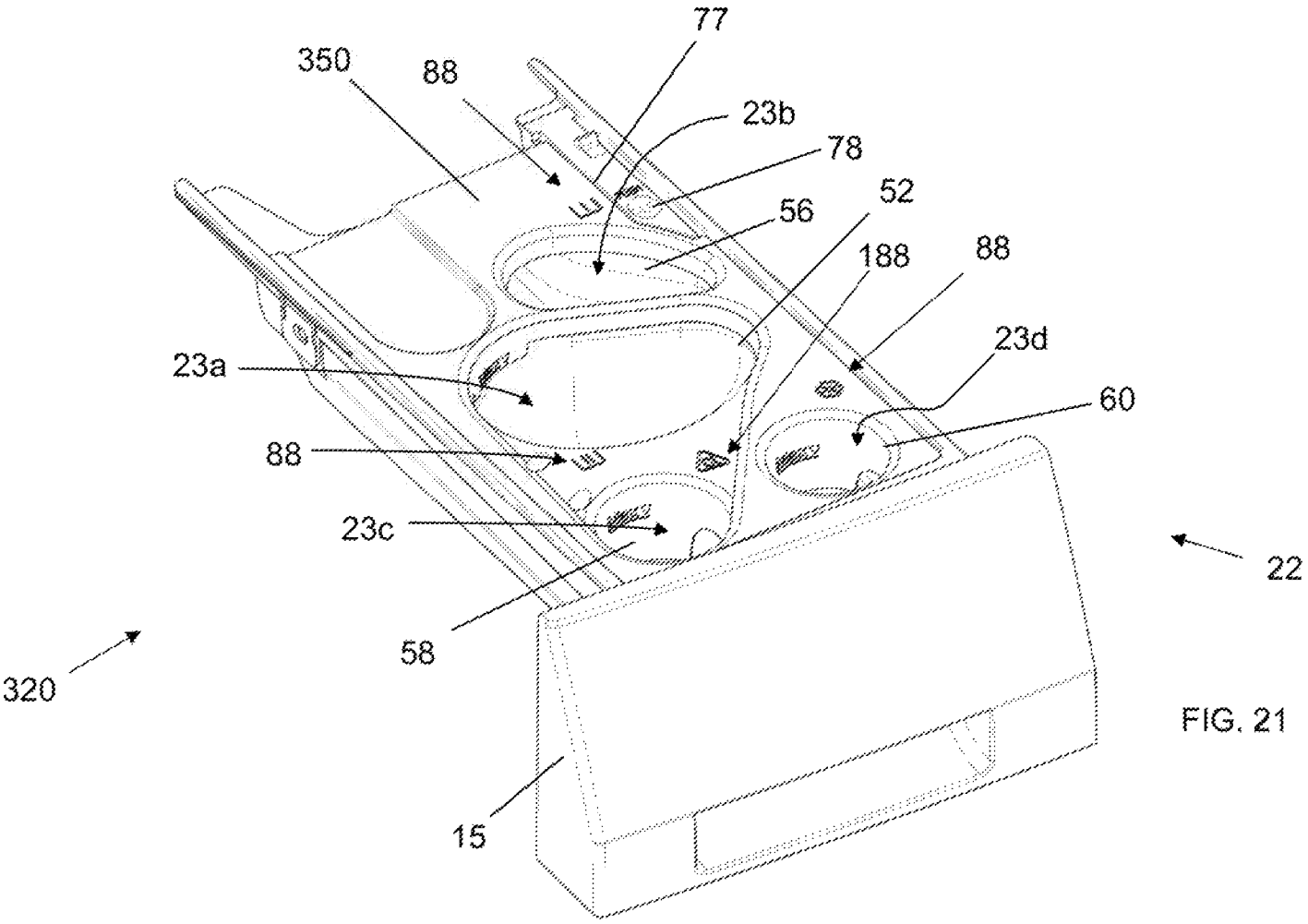
FIG. 21 shows a cover element according to a further preferred embodiment of the invention associated to a drawer.

With reference to FIG. 21 a treating agents dispenser 320, without water dispenser, according to a further preferred embodiment of the invention is described.

The treating agents dispenser 320 differs from the treating agents dispenser 20 previously described with reference to FIGS. 17 to 19 in that the cover element 350 does not provide for the second aperture 54.

In this preferred embodiment, the washing cycle does not comprise a main wash phase which uses a pod.

The drawer 22 underlying the cover element 350 may be preferably the same above described with reference to previous embodiments.

Figure 22:
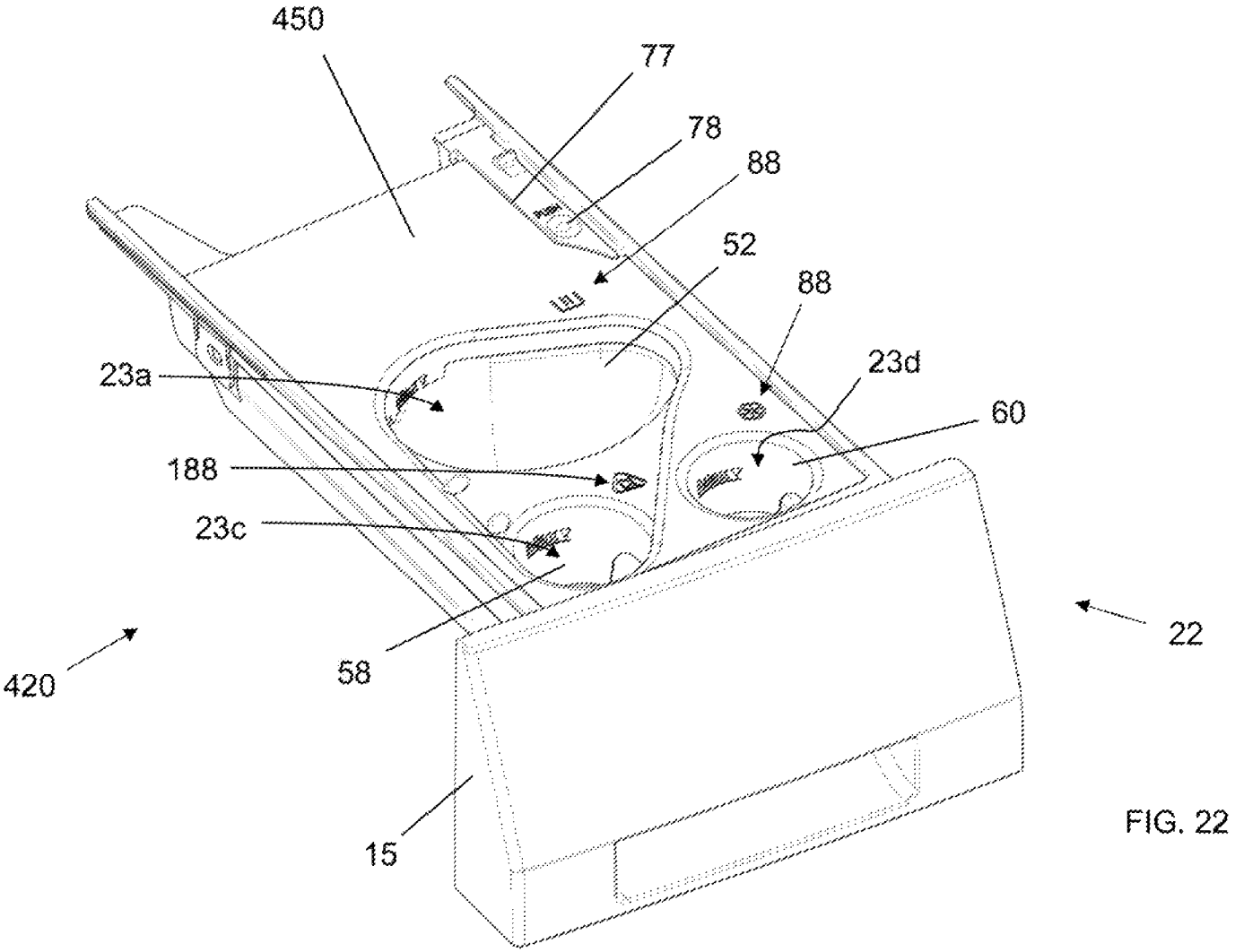
FIG. 22 shows a cover element according to a further preferred embodiment of the invention associated to a drawer.

With reference to FIG. 22 a treating agents dispenser 420, without water dispenser, according to a further preferred embodiment of the invention is described.

The treating agents dispenser 420 differs from the treating agents dispenser 120 previously described with reference to FIGS. 17 to 19 in that the cover element 450 does not provide for the second 54 and the third apertures 56.

In this preferred embodiment, the washing cycle does not comprise a main wash phase which uses a pod and does not comprise a pre-wash phase.

The drawer 22 underlying the cover element 450 may be the same above described with reference to previous embodiments.

In different embodiments, the second compartment of the drawer, of the type previously described, may be omitted.

Figure 23:
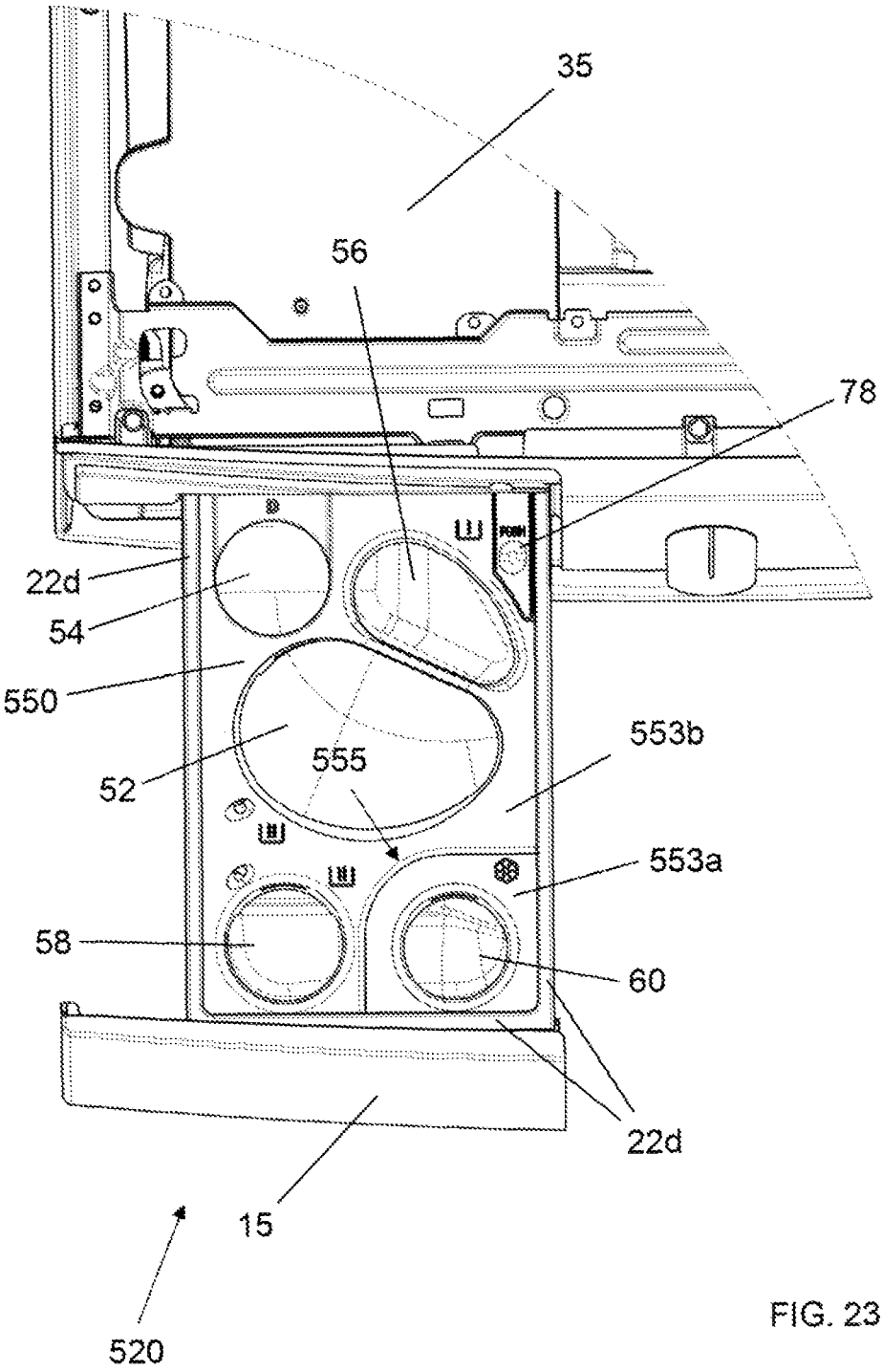
FIG. 23 shows a further preferred embodiment of the treating agents dispenser of FIG. 4.

With reference to FIG. 23 a treating agents dispenser 520 according to a further preferred embodiment of the invention is described.

The treating agents dispenser 520 differs from the treating agents dispenser 20 previously described with reference to FIGS. 1 to 16 in that the fifth aperture 60 of the cover element 550 is preferably realized in a flat surface 553*a* which is at a higher level with respect to the adjacent surface 553*b* where the first 52, second 54, third 56 and fourth 58 apertures are realized.

The levels difference between said surfaces 553*a*, 553*b* defines a small protective barrier 555 which prevents the overflow of water from adjacent surfaces.

This preferred embodiment achieves all the advantages above described for the previous embodiments.

From the above description, it can be appreciated that the different embodiments of the treating agents dispensers may preferably easily obtained by only substituting the cover element. In other words, the different embodiments of the treating agents dispensers may be manufactured utilizing the same components, except from the cover element. Manufacturing costs are therefore reduced.

While in the preferred embodiments illustrated the drawer comprises four compartments, it has to be underlined that in different embodiments the number of compartments may be different, even just one.

It has to be understood that also the shape of the compartments may be any shape suitable to receive a treating agent therewith.

It has thus been shown that the present invention allows all the set objects to be achieved. In particular, it makes it possible to realize a laundry washing machine that makes it possible to reduce or prevent residues of treating agent in the treating agents dispensers.

It is underlined that the laundry washing machines illustrated in the enclosed figures are of the front-loading type; however it is clear that the system according to the invention can be applied as well to a top-loading laundry washing machine, substantially without any modification.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A laundry washing machine comprising:

a cabinet;

a washing tub supported in the cabinet;

a washing drum rotatably supported within the washing tub and configured to receive laundry therein;

a treating agents dispenser connectable to an external water source and fluidly connected to the washing tub, the treating agents dispenser comprising:

a drawer having an upper side comprising one or more open-top compartments for receiving at least one agent for treating laundry, a supporting structure on which the drawer can slide, a water distributor arranged above the drawer and comprising at least one channel for conveying water from the external water source to at least one of the one or more compartments of the drawer, and a cover element arranged between the drawer and the water distributor, the cover element comprising at least a first aperture and a second aperture positioned above a first compartment of the one or more open-top compartments, wherein the first compartment comprises:

a first portion of the first compartment, which is positioned below the first aperture, a second portion of the first compartment, which is positioned below the second aperture, and an open side, wherein the second portion of the first compartment is positioned between the first portion of the first compartment and the open side, such that a flow of water entering the first portion of the first compartment through the first aperture flows through the second portion of the first compartment and out of the first compartment through the open side primarily by gravity.

2. The laundry washing machine according to claim 1, wherein the cover element further comprises at least one additional aperture positioned above a second compartment of the one or more open-top compartments.

3. The laundry washing machine according to claim 2, wherein a size of at least one of the first aperture, the second aperture and the at least one additional aperture is smaller than a size of a respective underlying compartment.

4. The laundry washing machine according to claim 2, wherein at least a portion of a boundary line of at least one of the first aperture, the second aperture and the at least one additional aperture follows a boundary line of a respective underlying compartment.

5. The laundry washing machine according to claim 2, wherein at least one of the first aperture, the second aperture and the at least one additional aperture comprises a rim extending downwardly from a boundary line of the aperture towards a respective underlying compartment.

6. The laundry washing machine according to claim 5, wherein at least a portion of the rim is received in a recess of the respective underlying compartment.

7. The laundry washing machine according to claim 1, wherein the cover element comprises at least one level indicator for the at least one treating agent.

8. The laundry washing machine according to claim 1, wherein the drawer comprises a border rim which at least partially externally delimits the compartments and the cover element peripherally borders the border rim.

9. The laundry washing machine according to claim 1, wherein the cover element has a length so that it is partially inserted in the supporting structure when the drawer is in a maximum opened position.

10. The laundry washing machine according to claim 1, wherein the cover element is removably connected to the upper side of the drawer.

11. The laundry washing machine according to claim 2, wherein a first one of the first aperture, the second aperture and the at least one additional aperture is provided in a first surface of an upper side of the cover element and a second one of the first aperture, the second aperture and the at least one additional aperture is provided in a second surface of the upper side of the cover element, wherein the first surface is at a different vertical level with respect to the second surface.

12. The laundry washing machine according to claim 2, wherein a first one of the first aperture, the second aperture and the at least one additional aperture is provided in a first surface of an upper side of the cover element and a second one of the first aperture, the second aperture and the at least one additional aperture is provided in a second surface of the upper side of the cover element, wherein the first surface and the second surface are separated by a protective barrier.

13. The laundry washing machine according to claim 1, wherein at least one of the one or more compartments comprises an outlet configured to fluidly connect the at least one of the one or more compartments to an underside of the drawer.

14. The laundry washing machine according to claim 1, wherein an underside of the cover element comprises a cap siphon.

15. The laundry washing machine according to claim 1, wherein the first portion of the first compartment comprises a bowl, and the second portion of the first compartment comprises a channel extending from the bowl to the open side.

16. The laundry washing machine according to claim 1, wherein:

the drawer extends in lateral direction that is perpendicular to a sliding direction of the drawer, between a first side wall portion and a second side wall portion;

the first portion of the first compartment is positioned at a central location between the first side wall portion and the second side wall portion; and the second portion of the first compartment is offset along the lateral direction at a location next to the first side wall portion.

17. The laundry washing machine according to claim 16, wherein a second compartment of the one of more open-top compartments is located along the lateral direction between the second portion of the first compartment and the second lateral side wall portion, and along the sliding direction between the first portion of the first compartment and an end of the drawer.

18. The laundry washing machine according to claim 16, wherein the first portion of the first compartment extends in the lateral direction from the first side wall portion to the second side wall portion.

19. The laundry washing machine of claim 1, wherein the first compartment is curved with respect to a sliding direction of the drawer, with the second portion extending parallel to the sliding direction of the drawer.

20. The laundry washing machine of claim 1, wherein:

the drawer extends in lateral direction that is perpendicular to a sliding direction of the drawer, between a first side wall portion and a second side wall portion;

the first compartment has a first width along the lateral direction; and the second compartment has a second width along the lateral direction, the second width being less than the first width.

21. A laundry washing machine comprising:

a cabinet;

a washing tub supported in the cabinet;

a washing drum rotatably supported within the washing tub and configured to receive laundry therein;

a treating agents dispenser connectable to an external water source and fluidly connected to the washing tub, the treating agents dispenser comprising:

a drawer having an upper side comprising one or more open-top compartments for receiving at least one agent for treating laundry;

a supporting structure on which the drawer can slide;

a water distributor arranged above the drawer and comprising at least one channel for conveying water from the external water source to at least one of the one or more compartments of the drawer;

a cover element arranged between the drawer and the water distributor, the cover element comprising at least a first aperture and a second aperture positioned above a first compartment of the one or more open-top compartments and at least one additional aperture positioned above a second compartment of the one or more open-top compartments;

wherein:

the first aperture is positioned above a first portion of the first compartment, the second aperture is positioned above a second portion of the first compartment, the first compartment comprises an outlet aperture at a lower end of the first compartment, and the second portion of the first compartment is positioned between the first portion of the first compartment and the outlet aperture, such that a flow of water entering the first portion of the first compartment through the first aperture flows through the second portion of the first compartment and through the outlet aperture at the lower end of the first compartment; and wherein a first one of the first aperture, the second aperture and the at least one additional aperture is provided in a first surface of an upper side of the cover element and a second one of the first aperture, the second aperture and the at least one additional aperture is provided in a second surface of the upper side of the cover element, wherein the first surface is at a different vertical level with respect to the second surface.

22. A laundry washing machine comprising:

a cabinet;

a washing tub supported in the cabinet;

a washing drum rotatably supported within the washing tub and configured to receive laundry therein;

a treating agents dispenser connectable to an external water source and fluidly connected to the washing tub, the treating agents dispenser comprising:

a drawer having an upper side comprising one or more open-top compartments for receiving at least one agent for treating laundry;

a supporting structure on which the drawer can slide;

a water distributor arranged above the drawer and comprising at least one channel for conveying water from the external water source to at least one of the one or more compartments of the drawer;

a cover element arranged between the drawer and the water distributor, the cover element comprising at least a first aperture and a second aperture positioned above a first compartment of the one or more open-top compartments and at least one additional aperture positioned above a second compartment of the one or more open-top compartments;

wherein:

the first aperture is positioned above a first portion of the first compartment, the second aperture is positioned above a second portion of the first compartment, the first compartment comprises an outlet aperture at a lower end of the first compartment, and the second portion of the first compartment is positioned between the first portion of the first compartment and the outlet aperture, such that a flow of water entering the first portion of the first compartment through the first aperture flows through the second portion of the first compartment and through the outlet aperture at the lower end of the first compartment; and wherein a first one of the first aperture, the second aperture and the at least one additional aperture is provided in a first surface of an upper side of the cover element and a second one of the first aperture, the second aperture and the at least one additional aperture is provided in a second surface of the upper side of the cover element, wherein the first surface and the second surface are separated by a protective barrier.

23. A laundry washing machine comprising:

a cabinet;

a washing tub supported in the cabinet;

a washing drum rotatably supported within the washing tub and configured to receive laundry therein;

a treating agents dispenser connectable to an external water source and fluidly connected to the washing tub, the treating agents dispenser comprising:

a drawer having an upper side comprising one or more open-top compartments for receiving at least one agent for treating laundry;

a supporting structure on which the drawer can slide;

a water distributor arranged above the drawer and comprising at least one channel for conveying water from the external water source to at least one of the one or more compartments of the drawer;

a cover element arranged between the drawer and the water distributor, the cover element comprising at least a first aperture and a second aperture positioned above a first compartment of the one or more open-top compartments;

wherein:

the first aperture is positioned above a first portion of the first compartment, the second aperture is positioned above a second portion of the first compartment, the first compartment comprises an outlet aperture at a lower end of the first compartment, and the second portion of the first compartment is positioned between the first portion of the first compartment and the outlet aperture, such that a flow of water entering the first portion of the first compartment through the first aperture flows through the second portion of the first compartment and through the outlet aperture at the lower end of the first compartment; and wherein:

the drawer extends in lateral direction that is perpendicular to a sliding direction of the drawer, between a first side wall portion and a second side wall portion, the first portion of the first compartment is positioned at a central location between the first side wall portion and the second side wall portion, and the second portion of the first compartment is offset along the lateral direction at a location next to the first side wall portion.

24. The laundry washing machine according to claim 23, wherein a second compartment of the one of more open-top compartments is located along the lateral direction between the second portion of the first compartment and the second lateral side wall portion, and along the sliding direction between the first portion of the first compartment and an end of the drawer.

25. The laundry washing machine according to claim 23, wherein the first portion of the first compartment extends in the lateral direction from the first side wall portion to the second side wall portion.

* * * * *